US007762431B1

(12) United States Patent
Tuyls et al.

(10) Patent No.: US 7,762,431 B1
(45) Date of Patent: Jul. 27, 2010

(54) REFRIGERATED LIQUID PRODUCT DISPENSER

(75) Inventors: James M. Tuyls, Vacaville, CA (US); Antonio J. Jepson, Dixon, CA (US); John Dewing, Folsom, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 627 days.

(21) Appl. No.: 11/763,992

(22) Filed: Jun. 15, 2007

Related U.S. Application Data

(60) Provisional application No. 60/814,189, filed on Jun. 16, 2006.

(51) Int. Cl.
*B67D 7/80* (2010.01)

(52) U.S. Cl. ..... 222/146.6; 222/148

(58) Field of Classification Search ..... 222/146.6, 222/1, 251–263, 148–151, 146.1, 26, 23, 222/36; 134/167 R, 168 R, 168 C, 167 C, 134/169 R, 172, 173
See application file for complete search history.

(56) References Cited

U.S. PATENT DOCUMENTS

| | | | | | |
|---|---|---|---|---|---|
| 2,076,922 | A | * | 4/1937 | Simard | 62/338 |
| 2,189,950 | A | * | 2/1940 | Gump | 137/15.05 |
| 2,506,843 | A | * | 5/1950 | Seiler | 165/104.34 |
| 2,771,752 | A | * | 11/1956 | Tennant | 62/224 |
| 3,625,399 | A | * | 12/1971 | Heisler | 222/56 |
| 4,276,999 | A | * | 7/1981 | Reichenberger | 222/129.4 |
| 4,413,752 | A | * | 11/1983 | McMillin et al. | 222/56 |
| 4,477,003 | A | * | 10/1984 | Baker et al. | 222/642 |
| 4,572,230 | A | * | 2/1986 | Mirabile | 137/240 |
| 5,431,302 | A | * | 7/1995 | Tulley et al. | 222/14 |
| 5,624,056 | A | * | 4/1997 | Martindale | 222/148 |
| 5,906,296 | A | * | 5/1999 | Martindale et al. | 222/108 |
| 6,082,587 | A | * | 7/2000 | Martindale et al. | 222/108 |
| 2003/0183249 | A1 | * | 10/2003 | Nissinen et al. | 134/22.11 |
| 2009/0008407 | A1 | * | 1/2009 | Sevcik et al. | 222/1 |

* cited by examiner

*Primary Examiner*—Lien T Ngo
(74) *Attorney, Agent, or Firm*—Townsend and Townsend and Crew LLP

(57) ABSTRACT

A refrigerated liquid dispenser is disclosed. The dispenser has a pump configured for being in fluid communication with a source of a liquid product; a dispensing faucet configured for being in fluid communication with the pump, the dispensing faucet including a cold maintenance device located near the distal end of the dispensing faucet and an insulator device disposed adjacent to the cold maintenance device. The cold maintenance device has a distal end that projects beyond a lower surface of the insulator device. The dispenser also includes a dispensing tower for enclosing the dispensing faucet; and an auxiliary cooling circuit configured to direct cool airflow toward the dispensing faucet, the auxiliary cooling circuit having a passageway that is at least partially located within the dispensing tower and the passageway is configured to deliver cool airflow through the passageway onto the dispensing faucet, to shield the dispensing faucet from ambient temperature, thereby maintaining the dispensing faucet and the passageway at a cool temperature to avoid contamination of the liquid. The dispenser also includes a controller operatively coupled with the pump and the dispensing faucet to control the operation of the refrigerated liquid dispenser.

28 Claims, 22 Drawing Sheets

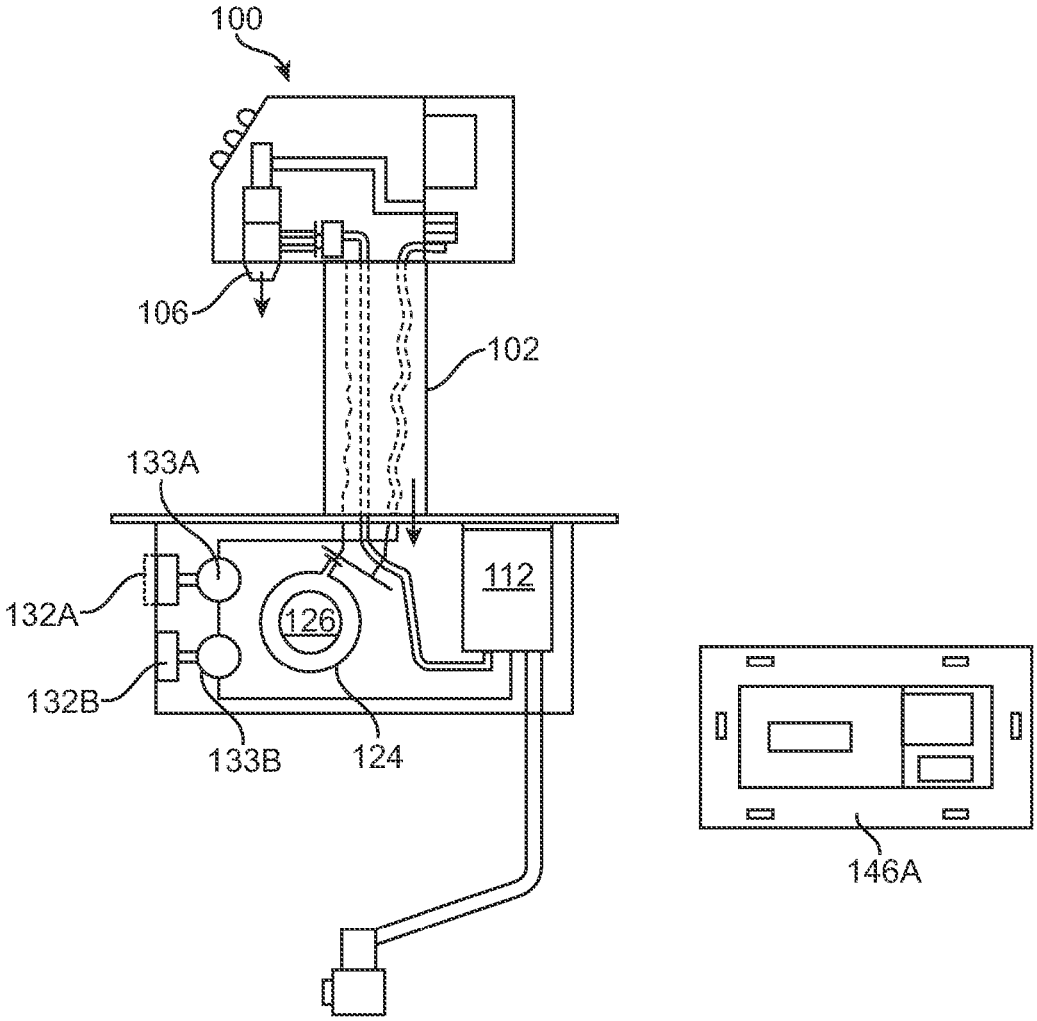
FIG. 3
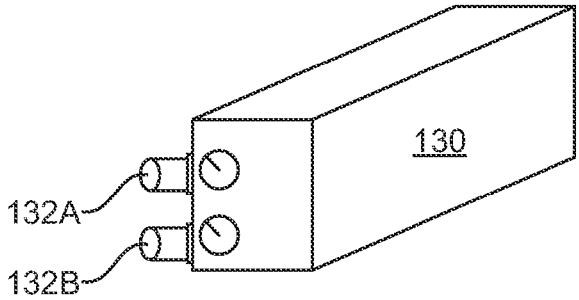

DISPENSER FLOWCHART

REFRIGERATED LIQUID PRODUCT DISPENSER

CROSS-REFERENCES TO RELATED APPLICATIONS

This application claims priority to U.S. Provisional Patent Application No. 60/814,189, filed Jun. 16, 2006 whose teachings are incorporated herein by reference.

BACKGROUND OF THE INVENTION

The present invention relates to liquid dispensers. In particular, the present invention is related to a refrigerated liquid product dispenser having a unique set of cooling features, as well as a novel clean-in-place cleaning and sanitation system.

The dispensing of liquid products such as dairy or egg products presents unique challenges. One challenge is related to the consistency of the product. For example, a specific pancake recipe may call for a specific portion of pancake batter, or a specific omelet recipe may call for a specific portion of eggs. A restaurant needs to have consistent portion control to both ensure a proper recipe and also to control product waste. Current dosing and usage procedures require the dipping of a selected size cup or ladle into an uncovered product vat, repeatedly to acquire the desired dose or portion. There is therefore a need for the accurate and consistent dispensing of a liquid, a dairy or an egg product. It is known that in the food service business, a 5-10 percent savings in food cost can be the difference between a profitable and a struggling business.

In addition to the dose consistency challenges, most, if not all, restaurants are concerned with the safety of the food. Dairy products and eggs are of specific concern for restaurants as these products are more likely to spoil faster in a hot kitchen environment. y wish to keep them safe. One way of maintaining safety is to make sure that dairy and egg products are maintained at refrigerated conditions. Refrigerated dairy dispensers and refrigerated kitchen work stations are known. FIG. 1A shows a typical egg station that is used in current commercial or industrial kitchens. FIG. 1A shows a typical egg station implementation for a cold-pan storage station. Such a station includes one or more ⅓ pans that sit in slots that hang over a refrigerated counter top height station. Using such a station, the egg or dairy product is kept cold (e.g., about 35-40° F.) by a refrigeration loop that is supplied to keep the station cold. The egg or dairy products are kept in the pans that hang from the top surface of the station. In such a station, where the egg or dairy product may be kept in open vats, the desired product is portioned by dipping of a selected size cup, ladle or other utensil into an uncovered product vat to acquire the desired dose or portion. Such utensils as well as the station itself need to be kept clean to ensure food safety.

Currently, all utensils and product handling equipment in an industrial kitchen setting are sanitized using a three-step, sink operation, and then the sanitized equipment is potentially exposed to environmental contamination.

There is therefore a need for a system for the accurate and consistent dispensing of liquid, dairy or an egg product where the safety of the food is not compromised and where the dispensing system can be easily cleaned in place, and which does not suffer from the above shortcomings.

BRIEF SUMMARY OF THE INVENTION

The present invention provides a refrigerated liquid dispenser. The dispenser has a pump configured for being in fluid communication with a source of a liquid product; a dispensing faucet configured for being in fluid communication with the pump, the dispensing faucet including a cold maintenance device located near the distal end of the dispensing faucet and an insulator device disposed adjacent to the cold maintenance device. The cold maintenance device has a distal end that projects beyond a lower surface of the insulator device. The dispenser also includes a dispensing tower for enclosing the dispensing faucet; and an auxiliary cooling circuit configured to direct cool airflow toward the dispensing faucet, the auxiliary cooling circuit having a passageway that is at least partially located within the dispensing tower and the passageway is configured to deliver cool airflow through the passageway onto the dispensing faucet, to shield the dispensing faucet from ambient temperature, thereby maintaining the dispensing faucet and the passageway at a cool temperature to avoid contamination of the liquid. The dispenser also includes a controller operatively coupled with the pump and the dispensing faucet to control the operation of the refrigerated liquid dispenser.

In one aspect, the refrigerated liquid dispenser also includes a sanitizing connector adapter configured to connect with the distal end of the dispensing faucet. The sanitizing connector adapter is configured to snap fit over the insulator device, where the sanitizing connector adapter when fitted to the insulator device creates a space that surrounds the distal end of the cold maintenance device. The sanitizing connector adapter can be configured to form a seal with and fit over the insulator device, such that when the space is filled with a cleaning fluid, the distal end of the cold maintenance device is surrounded by the cleaning fluid.

In another aspect, the refrigerated liquid dispenser includes a pump discharge conduit that runs partly though the passageway.

In another aspect, the refrigerated liquid dispenser's cold maintenance device is made of a material that has a higher heat capacity and/or thermal conductivity than that of the insulator device.

In another aspect, the refrigerated liquid dispenser also includes a bag holder configured to hold a bag of liquid product, which is to be dispensed by the dispenser. The dispenser can also include an adapter configured to connect the bag with the inlet side of the pump.

In another aspect, the refrigerated liquid dispenser also includes a control selector switch operatively connected with the controller, where the control selector switch is selectable to operate the refrigerated liquid dispenser in a normal dispense mode and a cleaning mode.

The refrigerated liquid dispenser can also include a dispense selector switch operatively connected with the controller, wherein the dispense selector switch is configured to cause the dispenser to dispense a predetermined amount of liquid product through the dispensing faucet.

The refrigerated liquid dispenser can also include a cleaning mode selector switch operatively connected with the controller, wherein the cleaning mode selector switch is configured to operate the refrigerated liquid dispenser in a wash mode, a rinse mode and a sanitize mode.

In the wash mode, the controller is configured to cause a washing solution to be delivered from a source of a washing fluid through the dispensing faucet, so as to implement a wash cycle. The wash cycle can include a first period during which the pump is operating and the dispensing faucet is open and a second period during which the dispensing faucet is closed. The wash cycle can be one of several wash cycles.

In the rinse mode, the controller is configured to cause a rising solution to be delivered from a source of a rinsing fluid through the dispensing faucet, so as to implement a rinse cycle.

In the sanitize mode, the controller is configured to cause a sanitizing solution to be delivered from a source of a sanitizing fluid through the dispensing faucet, so as to implement a sanitizing cycle. The sanitize cycle can include a first period during which the pump is operating and the dispensing faucet is open and a second period during which the dispensing faucet is closed.

In another aspect, the refrigerated liquid dispenser also includes a temperature sensor configured for sensing the temperature within the dispensing tower near the dispensing faucet.

In another aspect, the refrigerated liquid dispenser also includes a display operatively coupled with the temperature sensor. Furthermore, the temperature sensor can be operatively coupled with the controller, with the controller being configured to prevent the dispensing of the liquid product when an over temperature condition is sensed by the temperature sensor.

In another aspect, the dispensing faucet is solenoid operated, and the pump is configured to deliver a substantially fixed flow rate, and wherein the total liquid product portion being dispensed by the refrigerated liquid dispenser is determined in part by a time period during which the dispensing faucet is kept open.

The pump can be a diaphragm pump, a centrifugal pump, or a peristaltic pump.

For a further understanding of the nature and advantages of the invention, reference should be made to the following description taken in conjunction with the accompanying figures. It is to be expressly understood, however, that each of the figures is provided for the purpose of illustration and description only and is not intended as a definition of the limits of the embodiments of the present invention.

BRIEF DESCRIPTION OF THE DRAWINGS

FIG. 3 is another simplified exemplary schematic diagram of a refrigerated liquid dispenser in accordance with another embodiment of the present invention.

DETAILED DESCRIPTION OF THE INVENTION

Figure 1A:
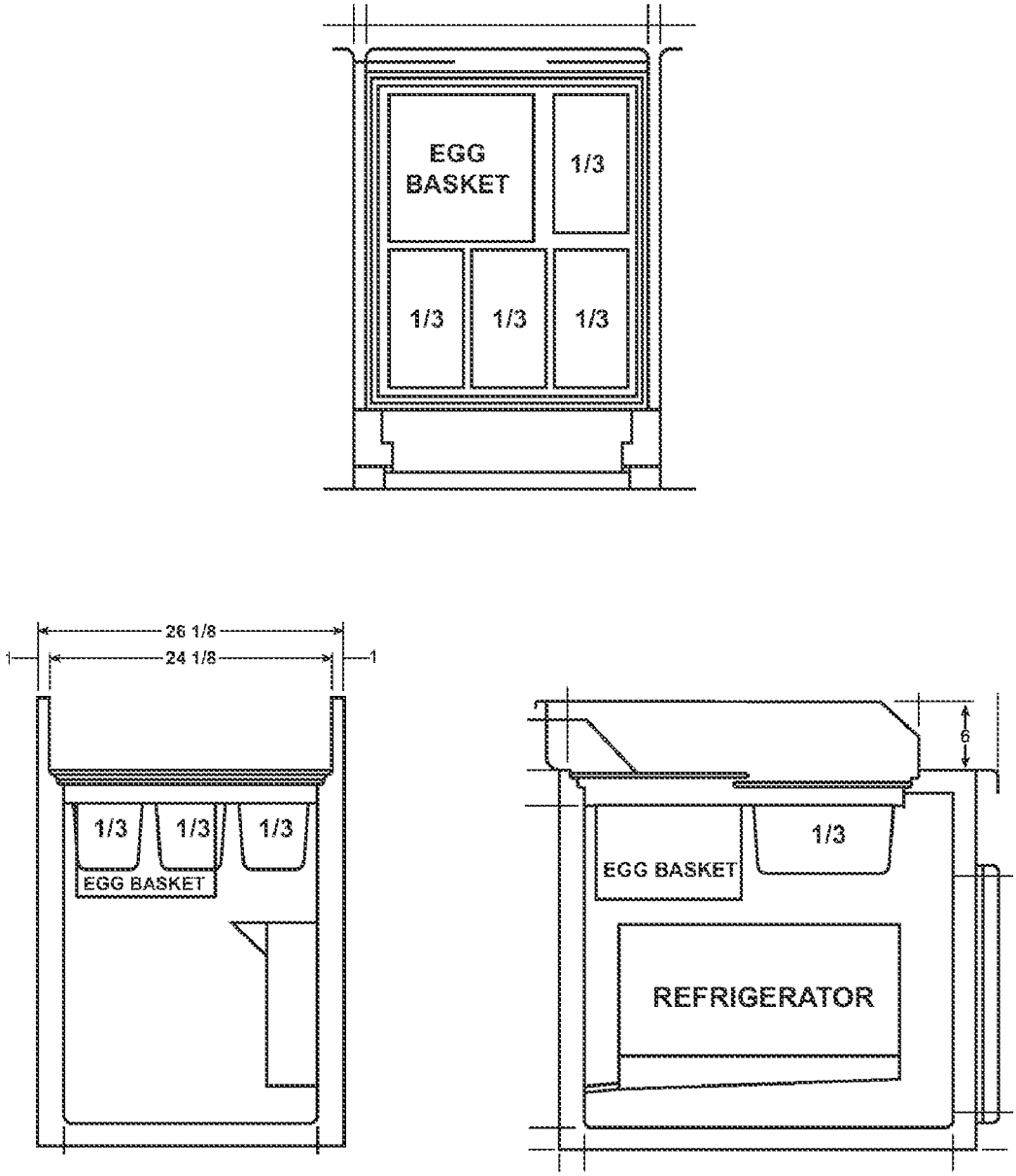
FIG. 1A shows a commonly available counter-top level refrigerated egg station that can be retrofitted to receive the refrigerated liquid dispenser in accordance with the embodiments of the present invention.

The embodiments of the present invention provide a systems for the portion-controlled dispensing of real liquefied eggs in a kitchen environment. In operation, using the liquid egg dispenser in accordance with the embodiments of the present invention, three or more different portion sizes of egg product can be selected and poured, quickly and sanitarily into a container, for example a cooking container. The egg product is dispensed and maintained at about 35-40° F., from a refrigerated source to the tip of the dispensing nozzle. All food contact components are designed to ensure desired clean-in-place sanitizing levels. A clean-in-place system is used to clean and sanitize the food contact dispensing path. A semi-automatic sanitizing system features a unique three-step operation that enhances the action and is compatible with most industry standard sanitizing chemicals. The liquid dispenser in accordance with the embodiments of the present invention is able to greatly improve the efficiency, safety and sanitary preparation and handling of refrigerated liquid products.

The liquid dispenser in accordance with the embodiments of the present invention can be installed into a refrigerated cold-pan storage unit, by placing the base of the dispenser into an available ⅓ pan slot. In such an arrangement, the dispenser can replace existing cold stored open vats of liquid eggs. In its most basic form, the refrigerated liquid dispenser includes a product bag holder; conduits for connecting the liquid product bag with the dispenser; and connections for AC power and/or compressed air, as well as a dispenser faucet, a dispensing tower, an auxiliary cooling circuit and a controller for controlling the refrigerated liquid product dispenser.

For the above retrofit-type configuration, liquid egg-product bag holders can be installed inside the refrigerated unit, below and approximately near the base of the dispenser tower. After proper sanitization, the liquid dispenser system is connected with sources of AC power and/or compressed air and with a fresh bag of egg-product or other liquid product. With the dispenser installed, the user can begin dispensing any desired dose of the refrigerated liquid product.

The liquid dispenser in accordance with the embodiments of the present invention, and especially when enhanced with National Sanitation Foundation (NSF) approved sanitizing procedures, virtually eliminates health threats related to the open containers of liquid dairy products or eggs. The inventive liquid dispenser by directly connecting to the food product container (e.g., a bag or a pouch) is able to reduce or eliminate the unsafe transfer of product into any open container. By directly selecting the desired portion-size button for a liquid product, the user can safely and accurately dispense the product for its subsequent use. Furthermore, the inventive liquid dispenser can clean all food contact surface parts without removing or replacing any of the routine parts of dispensing equipment.

While the liquid dispenser in accordance with the embodiments of the present invention is uniquely well-suited for dispensing a liquid egg product, it should be realized that the liquid dispenser can be configured to dispense any refrigerated, liquefied food products, with minor modifications, for example by implementing line-size and pumping pressure changes. For example, the liquid dispenser can be used to dispense liquid eggs, waffle and pancake batter, dairy sauces, creams, and so on, i.e. any liquid that can benefit from being kept at chilled conditions (e.g. 35-40° F.), from a refrigerated source all the way to the tip of the dispensing nozzle.

FIG. 1A shows a commonly available counter-top level refrigerated egg station that can be retrofitted to receive the refrigerated liquid dispenser in accordance with the embodiments of the present invention. As is shown in FIG. 1A, the egg station is a commonly-available refrigerated egg station. Such a station is used in a restaurant kitchen to prepare egg-based meals. Such a station is a likely environment that can be retrofitted with the refrigerated liquid product dispenser in accordance with the embodiments of the present invention.

Figure 1B:
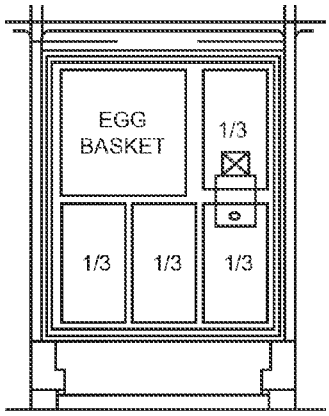
FIG. 1B shows the egg station of FIG. 1A retrofitted to receive the refrigerated liquid dispenser in accordance with the embodiments of the present invention.
Figure 1B:
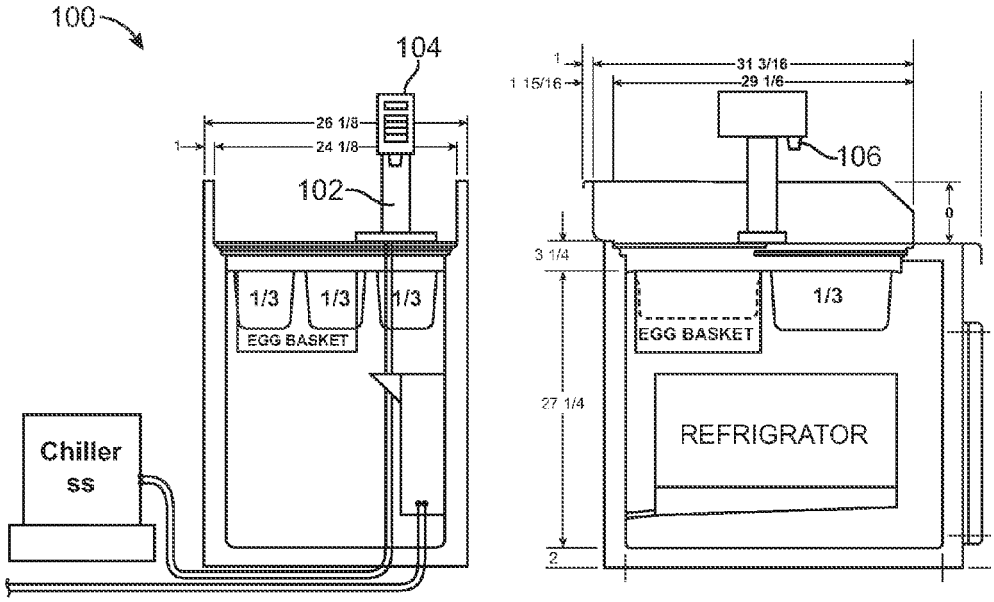

FIG. 1B shows the egg station of FIG. 1A retrofitted to receive the refrigerated liquid dispenser in accordance with the embodiments of the present invention. As is shown in FIG. 1B, the apparatus 100 can be mounted at the upper surface of the egg station. It includes a tower portion 102 that sits above the egg station. The tower portion includes a interface panel 104 that is accessible for use by the dispenser. The tower 102 also includes a faucet 106. The apparatus 100 can also include an external chiller or other cooling device that is used to keep the tower portion 102 at a desired temperature. As is shown in FIG. 1B, a common egg station can easily be retrofitted with the apparatus 100. With the retrofit, the common egg station is converted to include an accurate refrigerated liquid dispenser having a clean-in-place system to clean and sanitize the food contact dispensing path.

Figure 2:
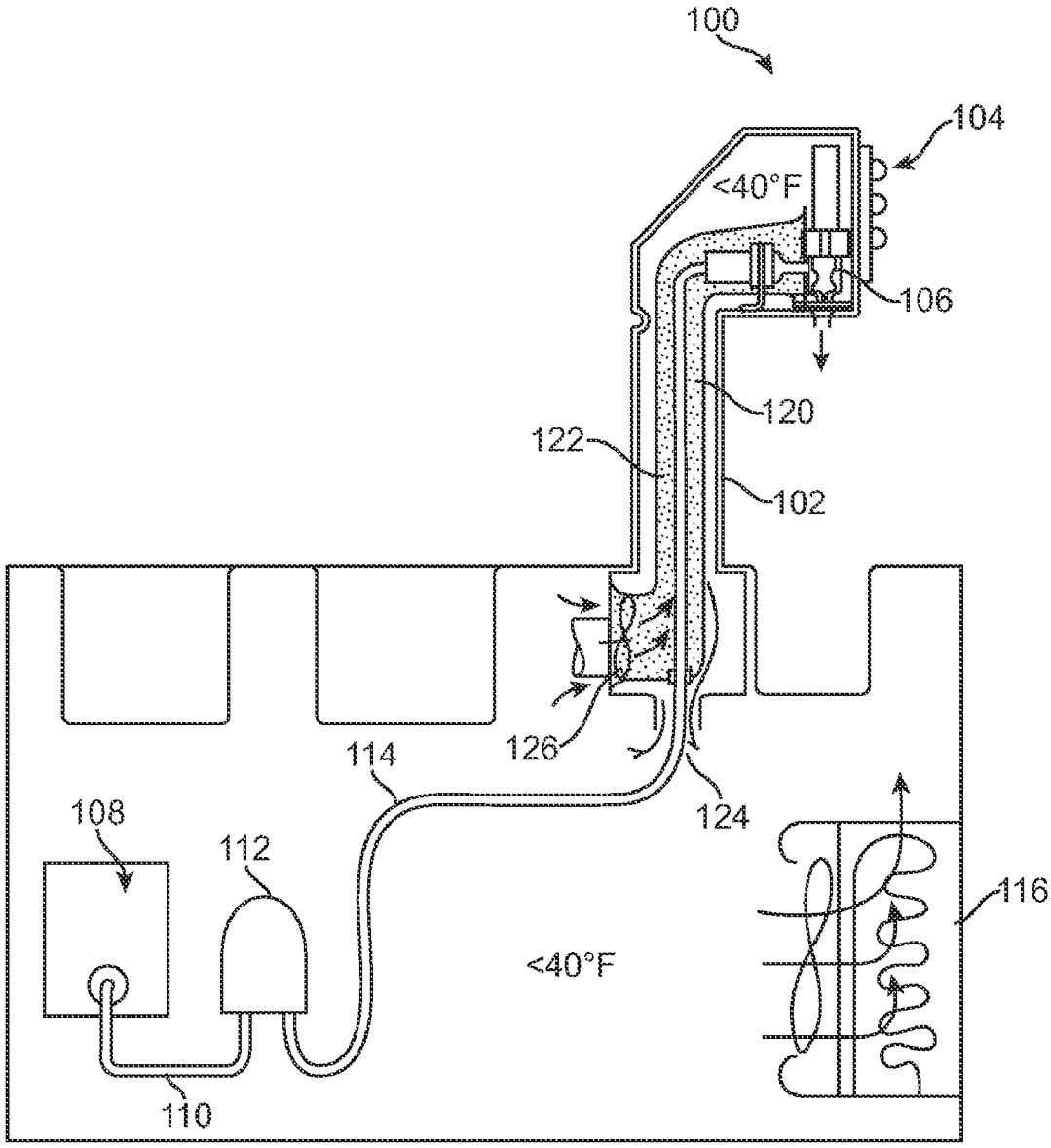
FIG. 2 is a simplified exemplary schematic diagram of a refrigerated liquid dispenser in accordance with one embodiment of the present invention.

FIG. 2 is a simplified exemplary schematic diagram of a refrigerated liquid dispenser 100 in accordance with one embodiment of the present invention. The dispenser 100 includes a tower portion 102 that is configured to sit near the top surface of the egg station. The dispenser system 100 includes a holder 108 that is used to hold a bag of liquid product (e.g. liquid egg). The dispenser system 100 includes piping, tubing and associated connectors 110 to connect a bag of product with a pump 112. The dispenser system 100 also includes piping, tubing and associated connectors 114 to connect the outlet of the pump 112 with the dispense valve 106. Portion control selector buttons 104 are used to control the dispensing of the product from the bag via the pump. It should be noted that the dispenser system 100 relies on the existence of cold air supplied by an appropriate fan-coil unit 116. Such a fan-coil unit is used by the work station to keep the station and its contents sufficiently cool. Such under counter refrigeration is designed to keep the cooled environment at or below about 40° F. However, the refrigeration supplied by the unit 116 is not sufficient to keep the space within the tower 102 sufficiently cool. An auxiliary cooling circuit 120 is provided to ensure that the environment within the tower is also cooled. The auxiliary cooling circuit 120 can include additional ducting 122 to direct cool air from the refrigerated environment via an inlet 124 towards the dispenser nozzle 106. The ducting 122 is designed to direct cool air towards the nozzle 106 and at the same time isolate the cooled internal space of the tower from other thermal loads, as is described below. The auxiliary cooling circuit 120 can also include a fan 126 to help urge cooling air into the ducting 122. The auxiliary cooling circuit 120 helps ensure that the space in the tower is also kept as cool as the remainder of the refrigerated station space.

FIG. 3 is another simplified exemplary schematic diagram of a refrigerated liquid dispenser 100 in accordance with another embodiment of the present invention. As shown in FIG. 3, the components other than the tower 102 of the dispenser system 100 can be designed to fit in a space occupied by the size of an ⅓ pan 130 to make for an efficient retrofitting of the dispenser to an existing work station. The unit 130 is shown to include connections 132A-B that can be used to supply the dispenser from appropriate pneumatic sources to operate the pump 112 and the dispenser valve 106. Downstream of the connections 132A-B are shown regulators 133A-B that are used to regulate the supplied air or gas pressure to levels appropriate for use by the pump 112 and the dispenser valve 106. FIG. 3 also shows that blower 126 can be used to direct cooled air from the refrigerated space below the tower up toward the dispensing nozzle 106.

Figure 4:
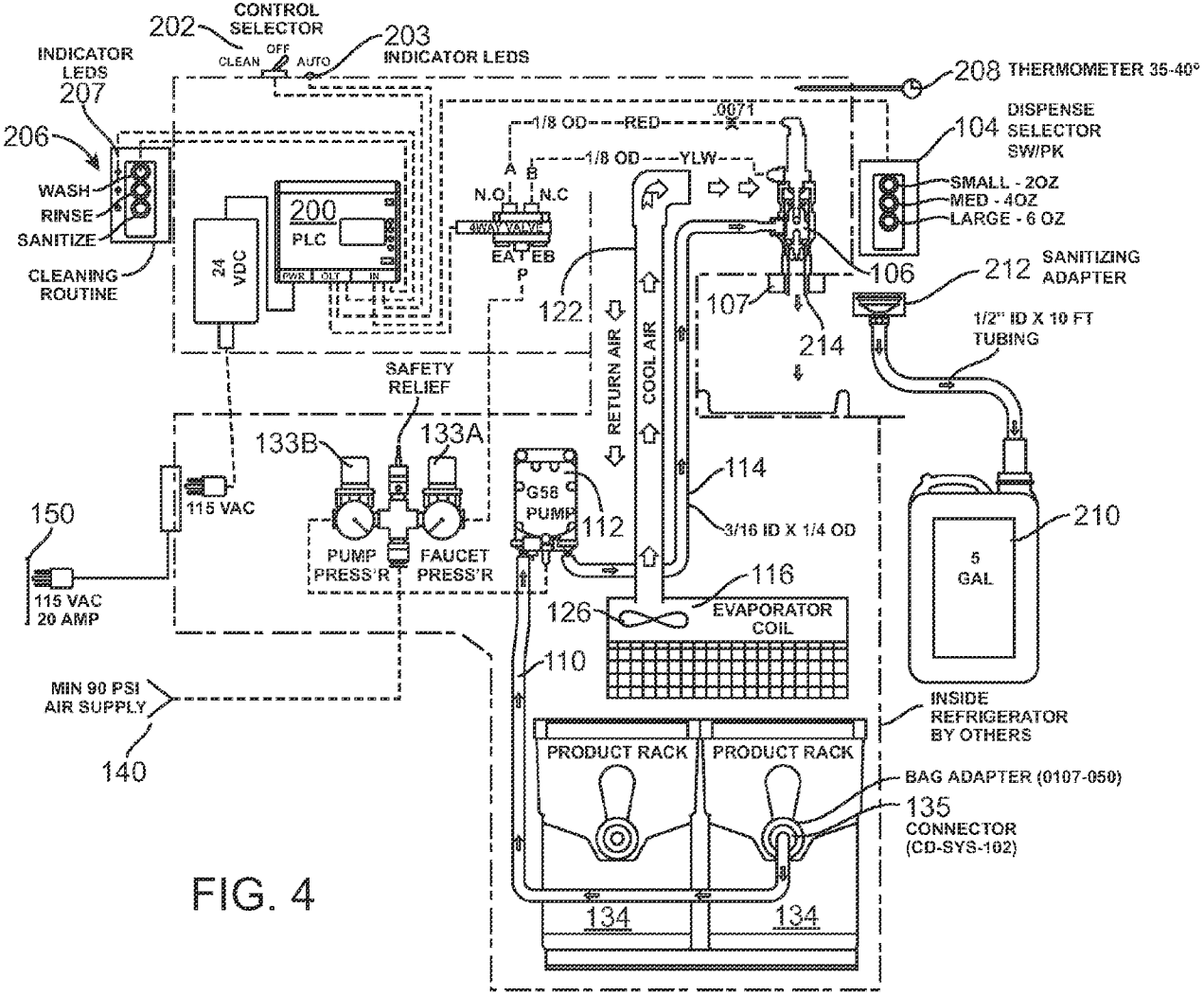
FIG. 4 is a simplified process flow diagram for a refrigerated liquid dispenser in accordance with one embodiment of the present invention.

FIG. 4 is a simplified process flow diagram 400 for a refrigerated liquid dispenser 100 in accordance with one embodiment of the present invention. As is shown in FIG. 4, the refrigerated liquid dispenser system includes a product rack 134 that is configured to hold a liquid product that is to be dispensed. Typically, a liquid product bag is held in the rack 134. Connectors and bag adapters 135 are used to connect a product bag with the inlet tubing 110 to the pump 112. The pump 112 delivers the liquid product via outlet tubing 114 to the faucet 106. Regulators 133A-B connect with air supply 140 to provide the motive force for the operation of the pump 112 and the faucet 106. The dispenser system also uses AC power 150, which also supplies the power to drive the programmable logic controller 200 that controls the logic for the operation of the dispenser system. With the dispenser properly connected with the AC power and compressed air, the dispenser can be easily operated by it user. The logic implemented by the PLC 200 for the operation of the dispenser 100 is described below in further detail.

Switch 202 is used to operate the dispenser in one of three modes. The switch can also include an indicator LED 203 to indicate which of its modes are set. With the switch in the Off position, the dispenser if turned off. With the switch set to "Auto," the dispenser is ready for its normal dispensing mode. With the switch set to the "clean" position, the dispenser is ready to operate in its clean-in-place sanitizing mode. The switch 202 functions such that once the dispenser is in the normal dispense mode, it is prevented from entering its cleaning mode and vice versa. With the switch 202 in its "Auto" mode the operator can use control panel 104 to specify a desired amount of refrigerated liquid product to be dispensed. For example, preset and/or programmable buttons 104 may be used to cause the dispenser to dispense small, medium or large portions. The selection of one of the buttons 104 will cause the dispenser to draw product via tubing 110 and deliver it to the faucet 106, while keeping the liquid product at chilled conditions from the rack 134 all the way to the faucet 106. As described above, the auxiliary cooling circuit 120 can deliver chilled air from a fan coil unit 116 to the faucet 106 via duct work 122. The discharge tubing or conduit for the pump can be routed through the passageway 122. The auxiliary cooling circuit 120 is a closed circuit loop in that the return air from the faucet gets routed back to the same refrigerated space from where it was routed. Temperature sensor 208 is used to measure and/or indicate the temperature near the faucet 106.

With the switch 202 in the "clean" position, the dispenser is ready to operate in its clean-in-place sanitizing mode. In this mode, the pump inlet 110 is disconnected from the product bags and is connected with either of the wash/rise/sanitize solutions. The solutions are then pumped through the dispenser and collected at a container 210. Control buttons 206 are used to operate the dispenser in either the wash/rinse/sanitize modes. Indicators 207 can also be used to provide a visual indication of the operational mode of the dispenser. The container 210 is connected with the nozzle 106 via a sanitizing adapter 212. The adapter 212 is configured to fit over portion 107 of the faucet. In one embodiment, adapter 212 snap fits over portion 107. The portion 107 can be an insulating material that is used to minimize heat gain to the nozzle and the faucet. As is seen in FIG. 4, the faucet 106 has a distal end 214 that projects past the portion 107. This geometry for the nozzle tip 214 comes to a sharp point to minimize the size of the food contact surface, and to create a good fluid breakaway surface that is also easily washable. The projection of the distal end 214 past the portion 107 ensures that adapter 212 first over and surrounds all food contact surfaces, to achieve an effective cleaning.

Figure 5:
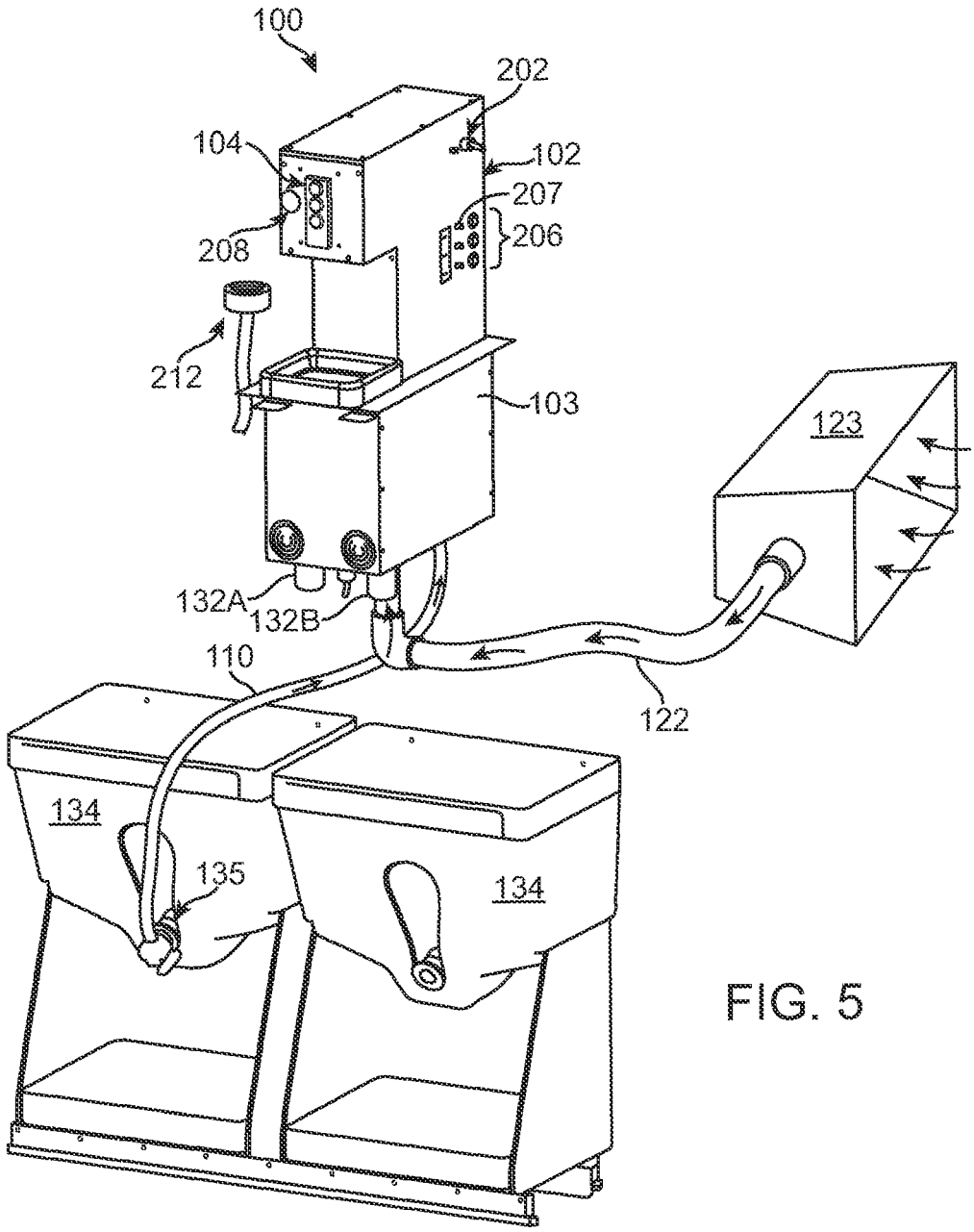
FIG. 5 is a simplified exemplary diagram illustrating certain aspects of the refrigerated liquid dispenser in accordance with the embodiments of the present invention.

FIG. 5 is a simplified exemplary diagram illustrating certain aspects of the refrigerated liquid dispenser in accordance with the embodiments of the present invention. The dispenser device 100 shown in FIG. 5, includes a pump enclosure 103 and a tower portion 102. The pump enclosure 103 receives tubing 110 to deliver the product from holder 134 to the pump. The pump enclosure 103 also receives the ductwork for the cooling air that is to be delivered to the tower 102. The pump enclosure 103 and/or the tower portion 102 can support the ductwork for the cooling air. Also shown are the pressure connections 132A and 132B. The cooling air is routed to the tower 102 via duct work 122. In one embodiment, a cold air scoop 123 is used at the inlet to the duct work 122. In certain cases, where a sufficient supply of cooling air is available, a separate fan is not used by the auxiliary cooling circuit and a cold air scoop 123 can be used to route cooling air for the auxiliary cooling circuit. The cold scoop is one type of inlet arrangement that is used. In addition to the scoop, other inlet arrangements that are shaped and dimensioned to act as a good inlet to duct work can also be used to help encourage the entry of cooling air into the ductwork. In addition, a filter can be placed near the inlet to the duct work 122. The embodiment of the dispenser 100 shown in FIG. 5 can have the operational mode switch 202 located near the back of the tower 102. Also shown near the back of the tower are controls 206 and indicators 207 that are for operating the wash/rinse/sanitize modes. In front of the tower 102 are shown the portion selection controls 104 and the tower temperature indicators 208. The sanitizing and drain connector 212 is also shown near the front of the tower.

In one embodiment, the refrigerated liquid dispenser is configured to dispense a liquid egg, a dairy product or other refrigerated fluids. The dispenser can be housed in one or more stainless steel enclosures. The dispenser can be configured to dispense one or more or several (e.g., small, medium and large) pour sizes. For example, the dispenser can be configured to dispense at a rate of 2 ounces per seconds and be configured to deliver 2 oz, 4 oz. or 6 oz portions corresponding to the small, medium and large pour sizes. The dispenser advantageously includes an automatic cleaning system that includes a wash cycle, a rinse cycle, a sanitize cycle and a priming cycle. The wash cycle can be configured to include 1 or more, or several (e.g., 5) repetitions of 15-seconds of pumping a wash solution, followed by a 1-minute of soaking. The rinse cycle can be configured to last for about 60-seconds to pump the dispenser with a fresh water rinse. The sanitize cycle can be configured to last for about a 30 second chlorinate sanitizer rinse and a 180 second sanitize soak. It should be noted that the above cleaning timing periods can be set to any values. The priming cycle can be configured to re-prime the dispenser with the refrigerated fluids. The dispenser can be powered by 110 VAC power. The system can be configured to use existing bag-in-box adapters and connectors to connect the liquid product that is in a bag with the pump's inlet conduit. In one embodiment, the refrigerated liquid dispenser can be totally self-contained requiring only bag-in-box eggs, 90 psi constant $CO_2$ or (dry) compressed air pressure, and 110 volt 60 hz AC power. The dispenser is refrigerated by the existing egg station refrigerator or refrigerated countertop egg station via an auxiliary cooling ductwork that helps move cold air, between the refrigerator evaporator and dispenser tower. A convenient thermometer is used to display the internal tower temperature.

Figure 6:
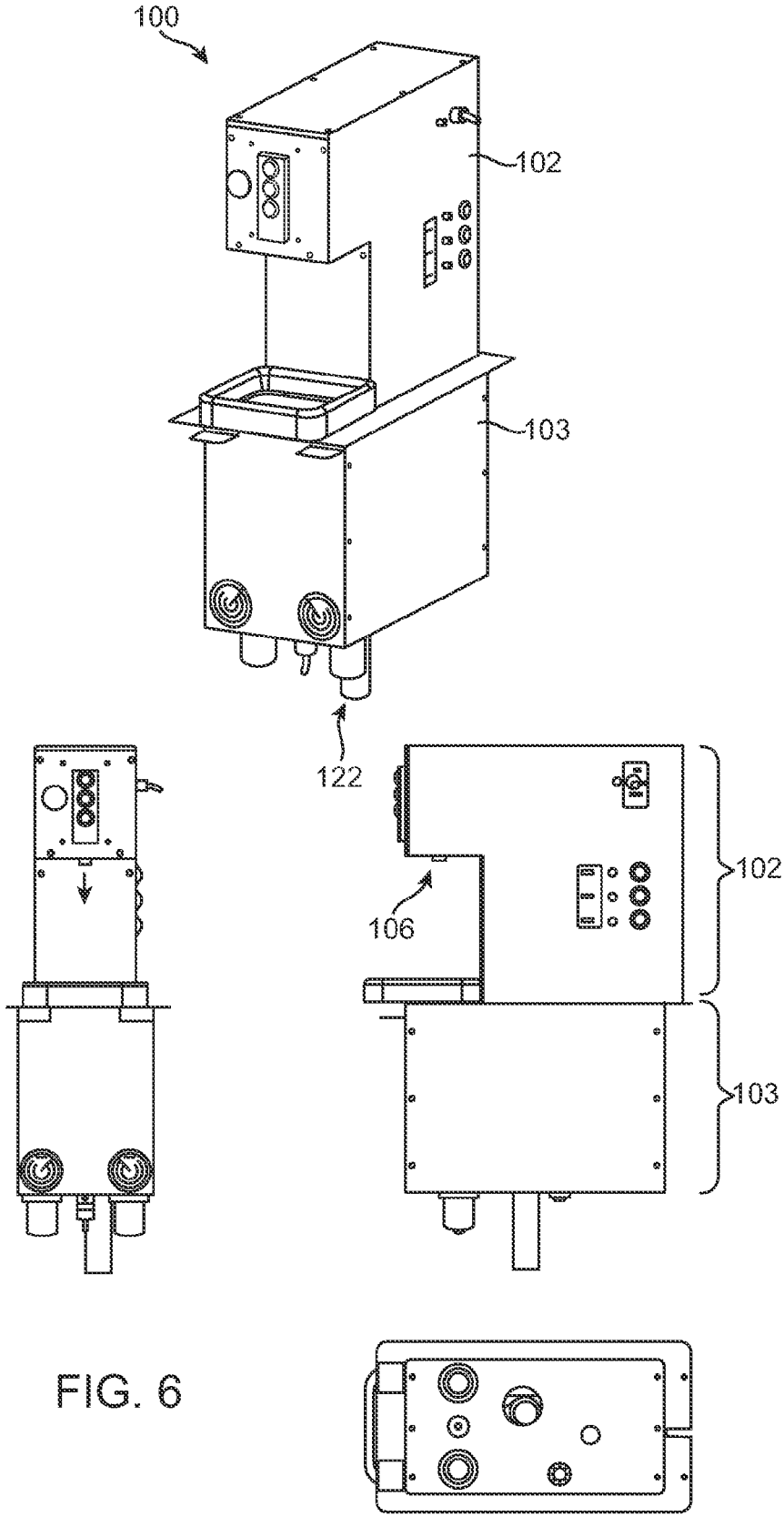
FIG. 6 is a simplified exemplary diagram illustrating certain aspects of the refrigerated liquid dispenser of FIG. 5.

FIG. 6 is a simplified exemplary diagram illustrating certain aspects of the refrigerated liquid dispenser of FIG. 5. FIG. 6 shows the dispenser 100 of FIG. 5 in a perspective as well as a front, a side and a top elevational view. As described above, the dispenser 100 when installed in a refrigerated work station (e.g., cold table) can have the tower portion be located above the cold table, and have the pump enclosure 103 be located inside the refrigerated cold table.

Due to the nature of the product that is being dispensed with the refrigerated liquid dispenser, it needs to be cleaned and sanitized once per day using the automatic three-step cleaning routine via Wash, Rinse, and Sanitize buttons in conjunction with the industry accepted cleaning and sanitation procedure and solutions. A long (e.g. 6-foot) cleaning hose with a nozzle adapter, a ¼" brush, and a ½" brush, can be included with the dispensing system as a part of its cleaning system.

Figure 7:
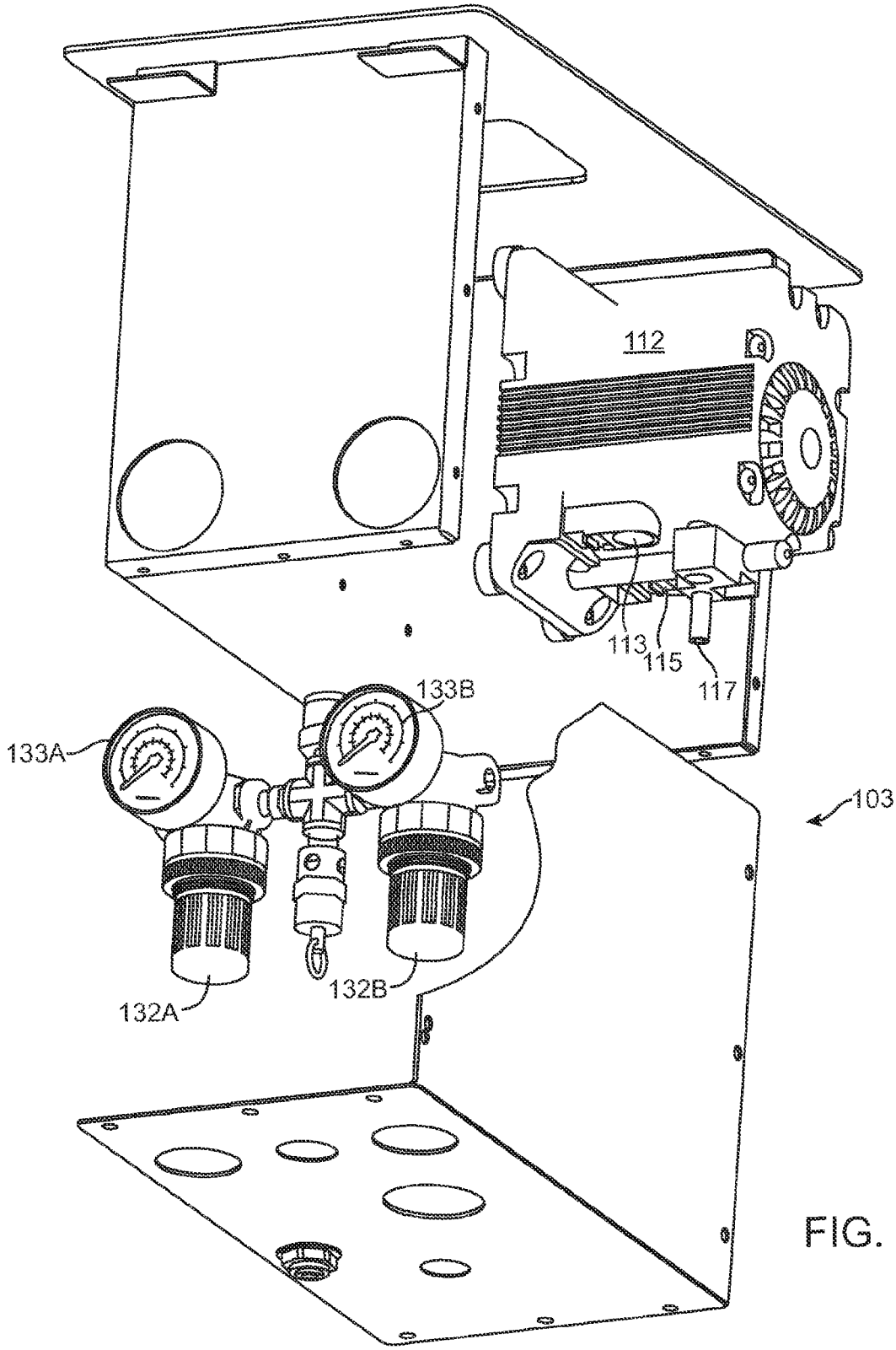
FIG. 7 illustrates certain details of the pump base portion of the of refrigerated liquid dispenser of FIG. 6.

FIG. 7 illustrates certain details of the pump enclosure portion 103 of the of refrigerated liquid dispenser 100 of FIG. 6. FIG. 7 shows the enclosure 103 to include the air pressure control manifold which includes connections 132A-B and regulators 133A-B. FIG. 7 also shows pump 112, its product inlet 113 and its product outlet 115, as well the compressed air inlet 117 for the pump 112. The housing for the enclosure is dimensioned to be easily adaptable to an industry standard cold table.

Figure 8:
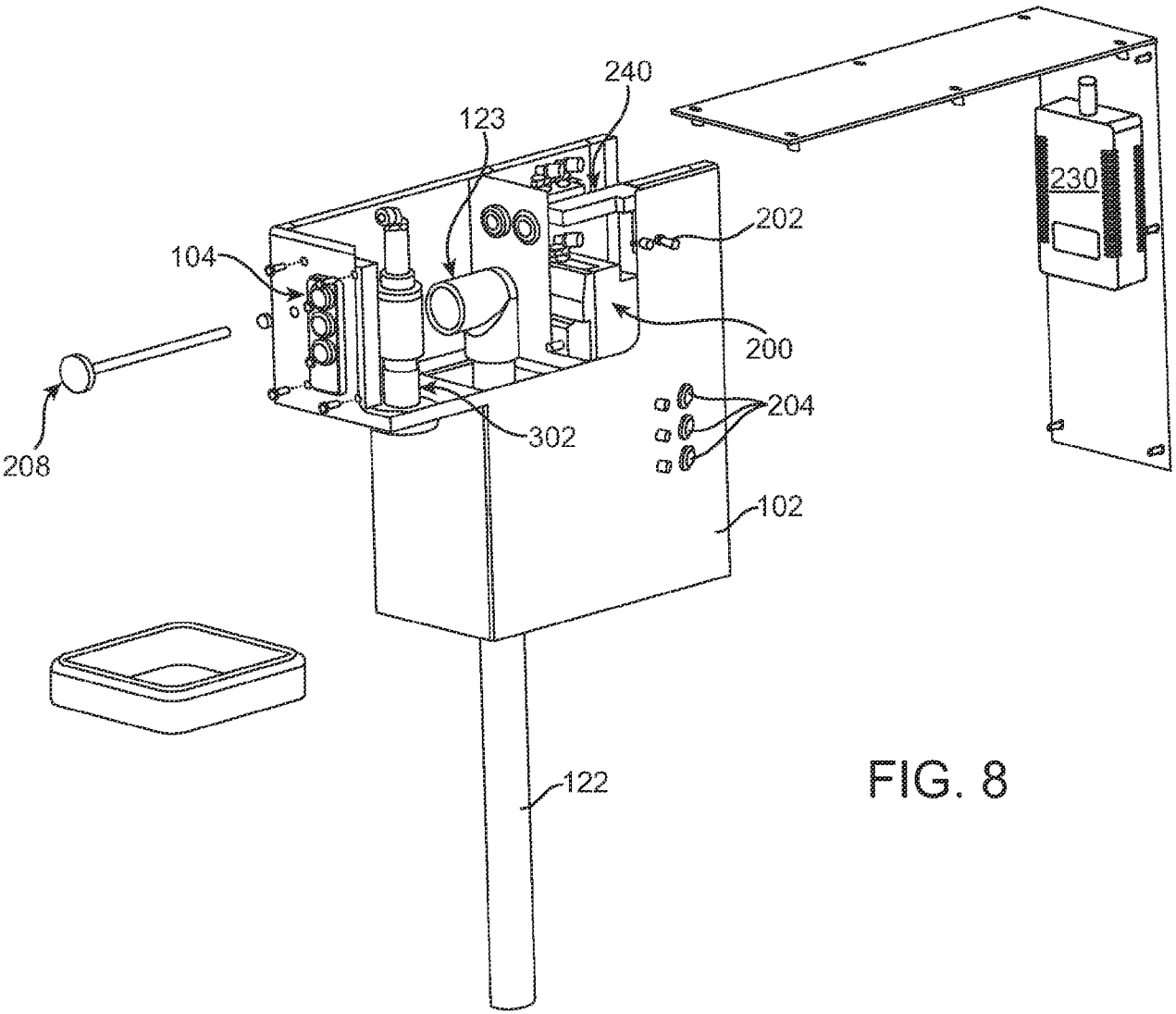
FIG. 8 illustrates certain details of the dispensing tower portion of the of refrigerated liquid dispenser of FIG. 6.

FIG. 8 illustrates certain details of the dispensing tower portion 102 of the of refrigerated liquid dispenser 100 of FIG. 6. The dispensing tower portion 102 is shown with certain housing portions removed to better illustrate the internals of the tower portion 102. FIG. 8 shows that a DC power supply 230 is housed near the back end of the tower 102. The power supply 230 provides the power for the PLC 200. The PLC 200 receives input from switches 202, 204 and 104. The PLC 200 interfaces with a 4-way valve controller 240 to control the actuator for the faucet 106. A cold draft input conduit 122 is used to supply cold air up into the tower and to cool the faucet 106. The cold draft input conduit 122 has as distal outlet 123 that is located near the faucet 106. During operation, the dispensing faucet is kept cool and the temperature near the faucet 106 is monitored by thermometer 208. The dispensing faucet 106 is shown to include a cold maintenance nozzle 302. The operation of the cold maintenance nozzle is described below in conjunction with FIG. 9.

Figure 9:
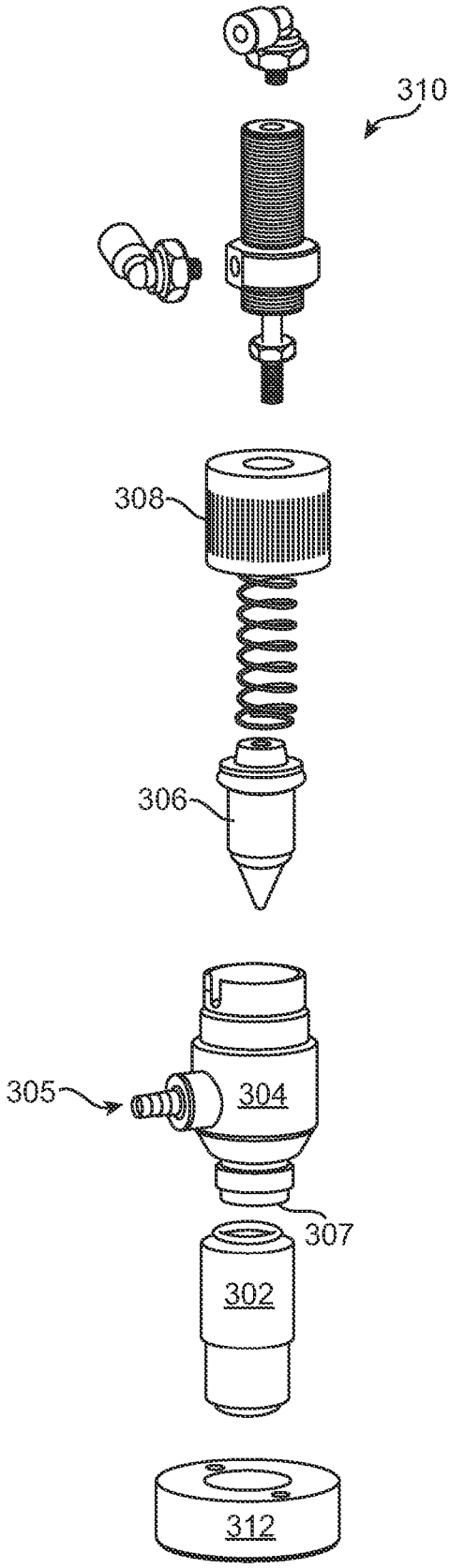
FIG. 9 illustrates certain details of the dispensing faucet of the refrigerated liquid dispenser of FIG. 6.
Figure 9:
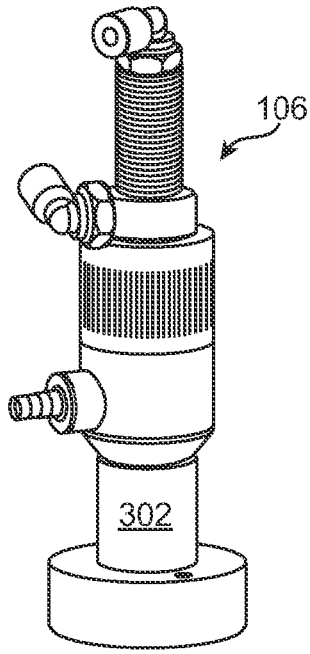

FIG. 9 illustrates certain details of the dispensing faucet 106 of the refrigerated liquid dispenser 100 of FIG. 6. The right hand side of FIG. 9 shows the assembled faucet 106 and the left hand side of FIG. 9 shows an exploded view of the faucet 106. The faucet 106 is shown to include a faucet body 304. The faucet body 304 has a product inlet 305 and an outlet 307. The flow of the product is controlled by the shut off plunger 306. The plunger 306 gets located within the faucet body 304 via a spring-biased assembly cap 308. The faucet 106 is pneumatically controlled via an air cylinder plunger/actuator 310. The outlet of the faucet body 307 is connected with the cold maintenance nozzle 302. The connection between the outlet of the faucet body 307 and the cold maintenance nozzle 302 can be a threaded connection, a friction fit, a press fit or a snap fit connection. The cold maintenance nozzle 302 is then received by the nozzle insulator 312. The distal end of the cold maintenance nozzle can project further past the lower surface of the nozzle insulator. As described above, the faucet 106 and its cold maintenance nozzle 302 are located within the dispensing tower 102 and as such are cooled with the cold air provided by the auxiliary cooling circuit. The cold maintenance nozzle 302 is made of a material and is dimensioned to have a sufficient thermal mass and a relatively high thermal conductivity so as to get cold with the cooling air supplied by the auxiliary cooling circuit. The higher thermal conductivity helps ensure a more uniform temperature distribution in the cold maintenance nozzle, thus ensuring that the cold maintenance nozzle is kept uniformly cold. ABS plastic materials can be used to make the cold maintenance nozzle and other faucet pieces, as appropriate. In addition to the ABS, other plastics such as PVC and PE plastics can be used. Alternatively, the cold maintenance nozzle can be made from a metal such as a metal rod that has been bored out. The bored-out rod can have sufficient thermal mass and higher thermal conductivity to provide the desired cooling effect to the faucet. In this manner, the very distal end of the faucet which can be positioned on the outside of the cooled tower portion, is kept at a chilled temperature range to ensure that the liquid product being dispensed is kept at the chilled conditions all the way to the end of the faucet, thereby minimizing or preventing the possible spoiling of the liquid product in a hot kitchen environment. The nozzle insulator 312 is configured to receive the cold maintenance nozzle. The nozzle insulator 312 is designed to be located on the outside of the tower housing to insulate the cold maintenance nozzle from the hot kitchen environment. The nozzle insulator 312 can also be used to more securely hold the faucet 106 with respect the tower housing 102. The cold maintenance device 302 has a portion that is inside the cooled tower portion and a small part that is outside the cooled environment, which is mostly covered by the nozzle insulator 312. A distal end of the maintenance device 302 projects past the lower surface of the nozzle insulator 312. That small portion and the nozzle insulator 312 minimize heat gain by the faucet. This minimization of heat gain by the faucet is a desired and advantageous feature, especially in a hot kitchen environment, because it helps keep all food contacted surfaces of the liquid dispenser at or below about 35-40° F. to insure that the food being dispensed does not spoil. As is shown, the cold maintenance nozzle is shown to be cylindrical and dimensioned to engage an annular-shaped nozzle insulator. These parts are made to be smooth and easily cleanable and maintainable by having external surfaces are smooth and which lack crevices or other surface features that would make their cleaning more difficult. It should be realized that other shaped cold maintenance nozzles can also be envisioned, as well as other shaped nozzle insulators that are complementarily-shaped to engage the cold maintenance nozzles. For example, the external surface of the cold maintenance nozzles can include extended surfaces, such as fins to help keep the cold maintenance nozzle cold.

Figure 14:
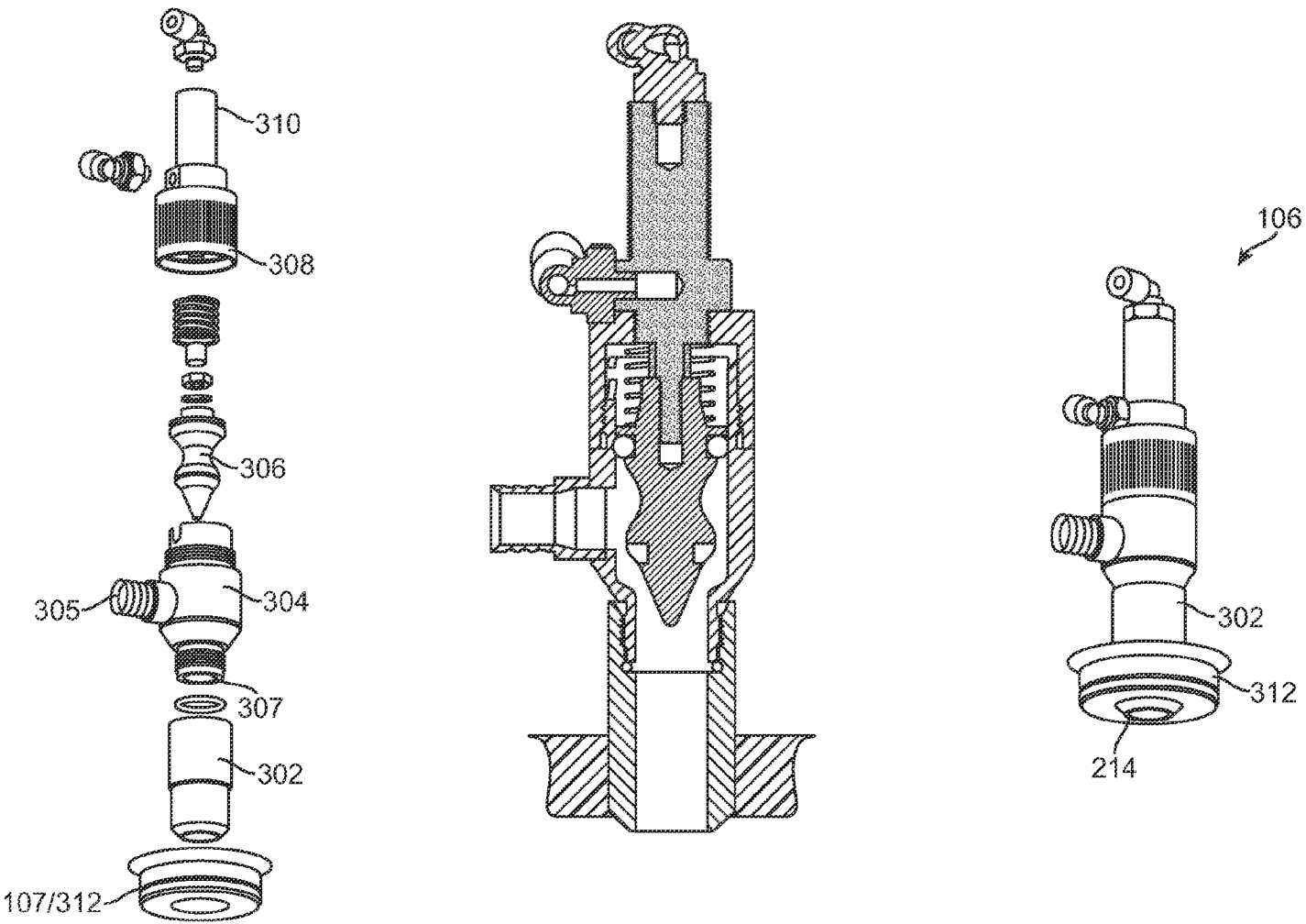
FIG. 14 illustrates certain details of an alternative embodiment of the dispensing faucet for the refrigerated liquid dispenser.

FIG. 14 illustrates further details of an embodiment of the dispensing faucet for the refrigerated liquid dispenser. The right hand side of FIG. 14 shows the assembled faucet 106 and the left hand side of FIG. 14 shows an exploded view of the faucet 106. A sectional view of the assembled faucet is also shown. The faucet 106 is shown to include a faucet body 304. The faucet body 304 has a product inlet 305 and an outlet 307. The flow of the product is controlled by the shut off plunger 306. The plunger 306 gets located within the faucet body 304 via a spring-biased assembly cap 308. The faucet 106 is pneumatically controlled via an air cylinder plunger/actuator 310. The outlet of the faucet body 307 is connected with the cold maintenance nozzle 302. The connection between the outlet of the faucet body 307 and the cold maintenance nozzle 302 can be a threaded fitting, a friction fit, a press fit or a snap fit connection. O-rings may be used between sub parts to ensure the presence of an effective seal. The cold maintenance nozzle 302 is then received by the nozzle insulator 312. The distal end 214 of the cold maintenance nozzle can project further past the lower surface of the nozzle insulator 312. As described above, the faucet 106 and its cold maintenance nozzle 302 are located within the dispensing tower 102 and as such are cooled with the cold air provided by the auxiliary cooling circuit. As is seen in FIGS. 4 and 14, the faucet 106 has a distal end 214 that projects past the portion 107 or 312. This geometry for the nozzle tip comes to a sharp point to minimize the size of the food contact surface, and to create a good fluid breakaway surface that is also easily washable. The projection of the distal end 214 past the portion 107 ensures that adapter 212 first over and surrounds all food contact surfaces, to achieve an effective cleaning.

Figure 10:
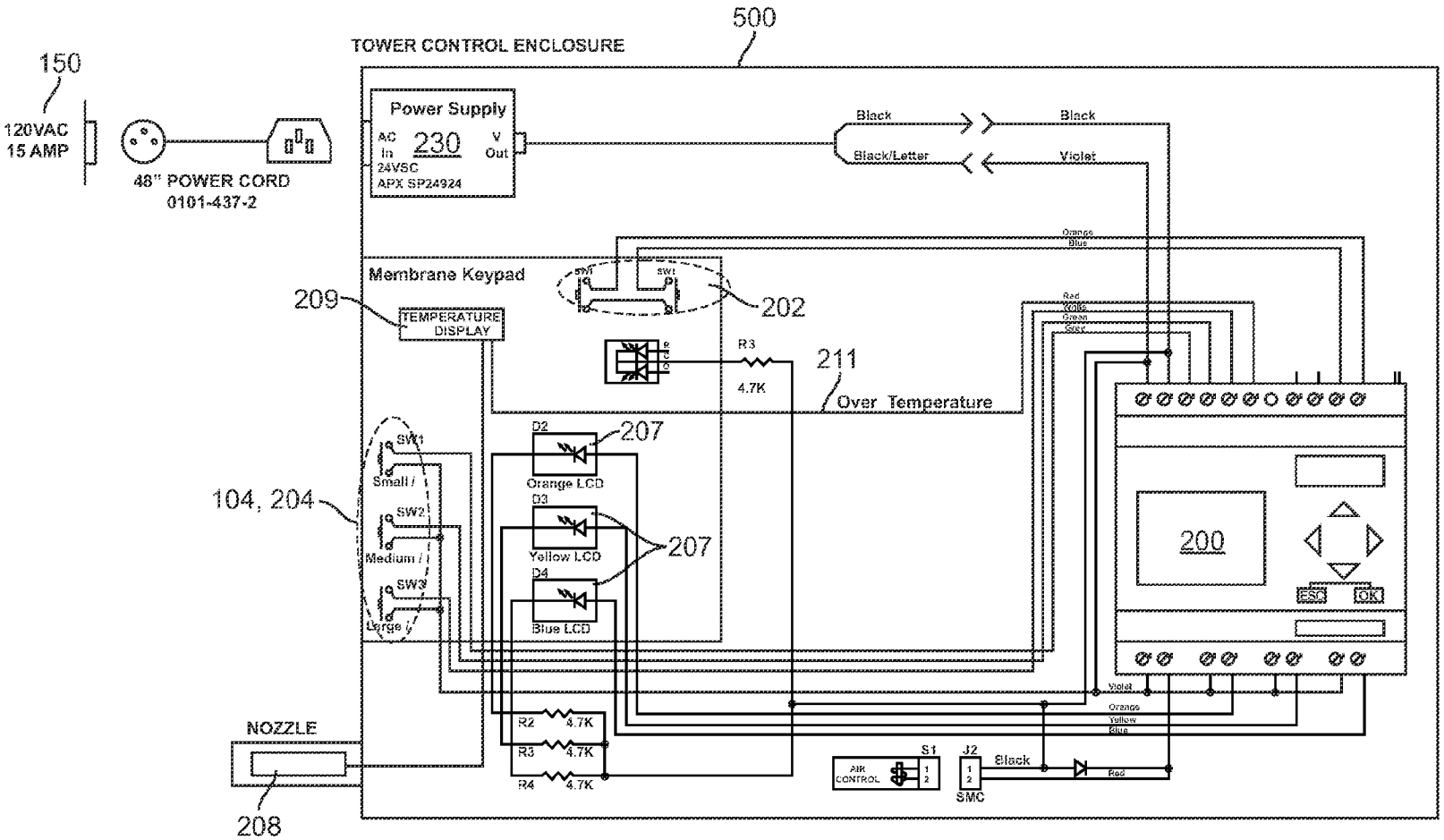
FIG. 10 is a simplified system layout drawing for a refrigerated liquid dispenser in accordance with one embodiment of the present invention.

FIG. 10 is a simplified system layout drawing 500 for a refrigerated liquid dispenser in accordance with one embodiment of the present invention. The layout drawing 500 shows that AC power 150 is provided to a DC power supply 230. The power supply 230 is used to drive the PLC 200. The PLC 200 receives input from switch 202 and switches 104 and/or 204. As is shown in the layout of FIG. 10, the same switches 104/204 can be used to control the normal dispensing operation of the device as well as its cleaning operation. It should be realized however, that a different set of switches can be used to operate the device in either of its normal dispense or the clean modes. The switch 202 is used to set the device in either of its normal dispensing or clean operational modes. The actuation of each of the switches 104 or 204 can also actuate the relevant indicators 207. The switches can be a part of the keypad of the dispenser. A thermocouple, or other suitable temperature sensor 208 is used to sense the temperature inside the tower housing and can be used to provide an input to a temperature display 209. When an over temperature condition is sensed, a signal 211 is provided to the PLC to prevent the dispensing of the liquid product in order to avoid unsanitary conditions. the over temperature condition can be set to a value higher than about 35-40° F. or any other set point.

Figure 11A:
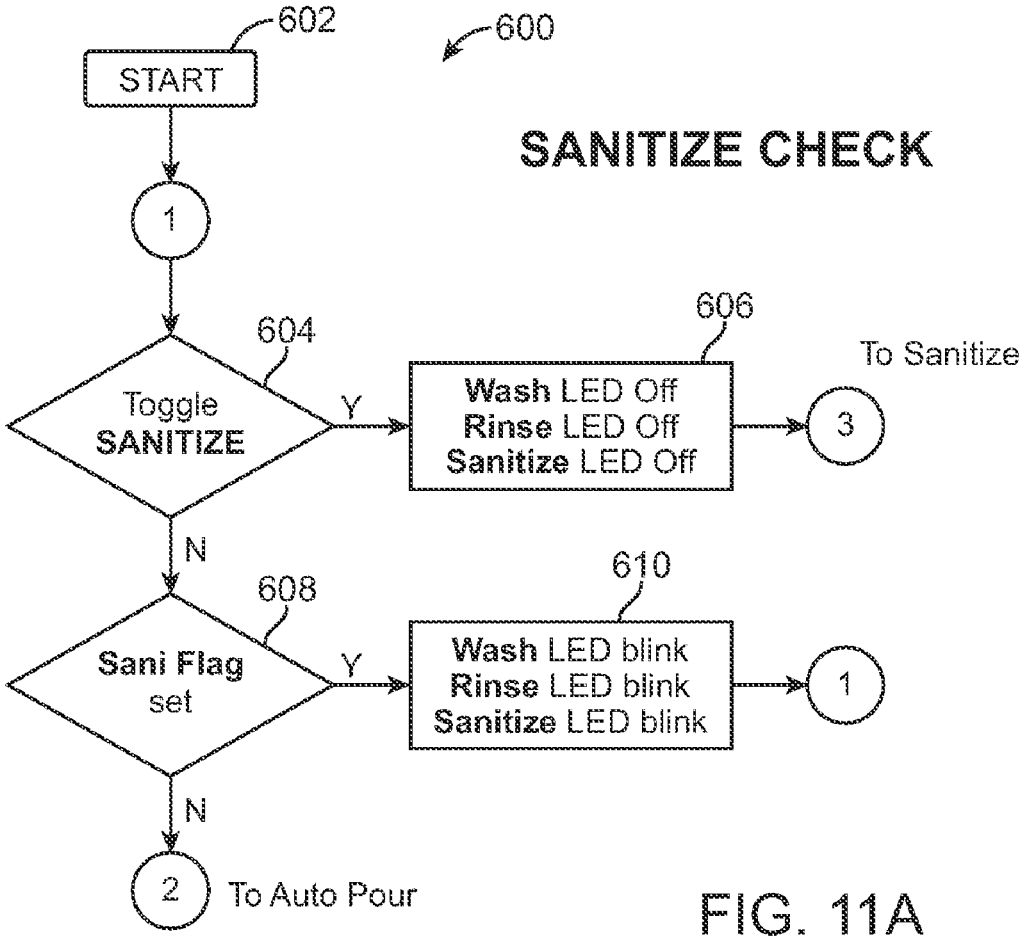
FIGS. 11A-F are simplified exemplary flow charts illustrating the operational logic of the refrigerated liquid dispenser in accordance with one embodiment of the present invention.

FIGS. 11A-F are simplified exemplary flow charts illustrating the operational logic of the refrigerated liquid dispenser in accordance with one embodiment of the present invention. The logic can be programmed for execution by the PLC 200. FIG. 11A illustrates the logic for the sanitize check state of the device. In the sanitize check mode, the controller can determine whether the device is allowed to go into a sanitize mode, or an auto pour mode. The logic starts at the start (step 602). Control moves to state 1 where it determines whether the switch has been set to the sanitize mode (step 604). When it is determined that the sanitize mode is selected control moves to step 606, where the wash, rinse and sanitize LED are turned off and control moves to state 3 to start the sanitization mode. When it is determined that a sanitize mode is not selected control moves to step 608, where it is determined whether the "Sani Flag" has been set. When the "Sani Flag" is set, the wash, rinse and sanitize LEDs will be set to blink and controls moves to state 1. While the Sani flag is set, the logic will not reset until the wash/rinse/sanitize cycle is completed. When it is determined at 608 that the Sani Flag is not set, then control moves to state 2, also referred to as the automatic pour state.

Figure 11B:
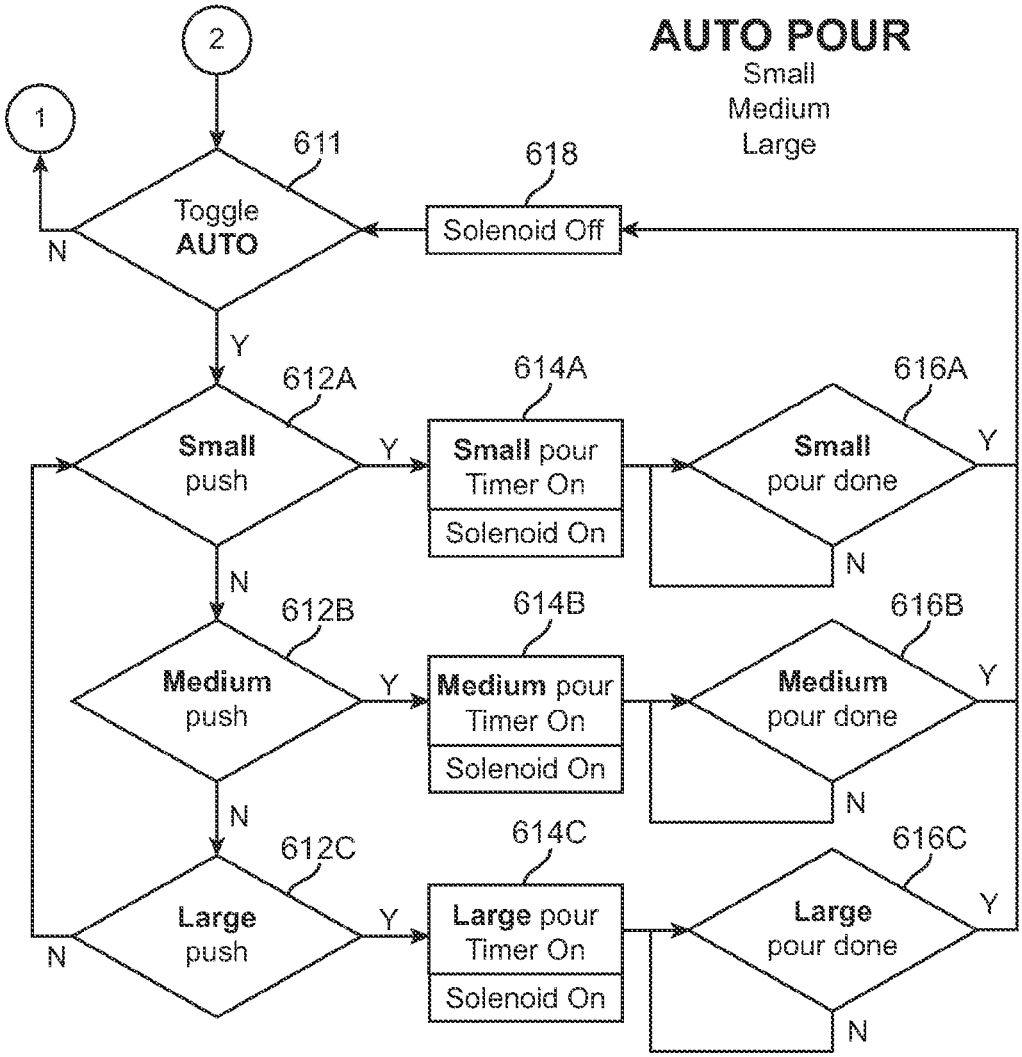

FIG. 11B illustrates the logic for the automatic pour state. In this state, the refrigerated liquid dispenser can be used to dispense preset portions. In one embodiment, the preset portions include a small, a medium and a large portion. The automatic pour state can be entered as described from the flow chart of FIG. 11A. In addition, the automatic pour state can be entered by setting the main switch to the "auto" setting. At step 611*a* determination is made. When the "auto pour" switch is not set, control returns to state 1. When the "auto pour" switch is set, the logic determines what size pour has been selected. When a small size has been selected, for example, by pushing the small dispense button (step 612A), the solenoid valve is opened and a small pour timer is turned on (step 614A). A determination is made to see if the small pour is complete (step 616A). As long as the small pour is not complete, the small timer stays on until the pour is complete. Once the desired portion has been dispensed, the solenoid is turned off (step 618). The determination of the pour size can be based on a timer setting for a predetermined and pre calibrated pour rate. When a small size is not selected, a determination is made to see if a medium portion has been selected (step 612B). When a medium size has been selected, for example, by pushing the medium dispense button (step 612B), the solenoid valve is opened and a medium pour timer is turned on (step 614B). A determination is made to see if the medium pour is complete (step 616B). As long as the medium pour is not complete, the medium timer stays on, until the pour is complete. Once the desired portion has been dispensed, the solenoid is turned off (step 618). When neither a small or a medium size is not selected, a determination is made to see if a large portion has been selected (step 612C). When a large size has been selected, for example, by pushing the medium dispense button (step 612C), the solenoid valve is opened and a medium pour timer is turned on (step 614C). A determination is made to see if the medium pour is complete (step 616C). As long as the large pour is not complete, the large timer stays on, until the pour is complete. Once the desired portion has been dispensed, the solenoid is turned off (step 618).

The refrigerated liquid dispenser in accordance with the embodiments of the present invention system includes a portion control logic that controls pour size amounts based on the amount of time that refrigerated liquid product is dispensed. The portion control logic can be located in the tower portion. Adjustments to compensate for changes in liquid product viscosity or formulation can be made to the pump pressure regulator to confirm that the liquid product is dispensing at the proper flow rate. To increase the amount poured, pump pressure can be increased.

As described above, the dispenser is usually operational in either the normal dispense or the sanitization modes. The sanitization mode, can include the wash, rinse and sanitize cycles. Since contaminated equipment is a risk factor contributing to food borne illness, the sanitation processes described herein provide for the effective cleaning and sanitizing of the refrigerated liquid dispenser. It is preferred to have the refrigerated liquid dispenser be cleaned and sanitized at a minimum, once per day using the following procedure. New or replacement connectors may be washed and sanitized prior to attachment to the system. The additional supplies that are needed for the cleaning include supplies of a wash fluid, a rinse fluid and a sanitizing fluid. It has been shown that one gallon of each of the wash/rinse/sanitize fluids can be sufficient to clean the dispenser.

Figure 11C:
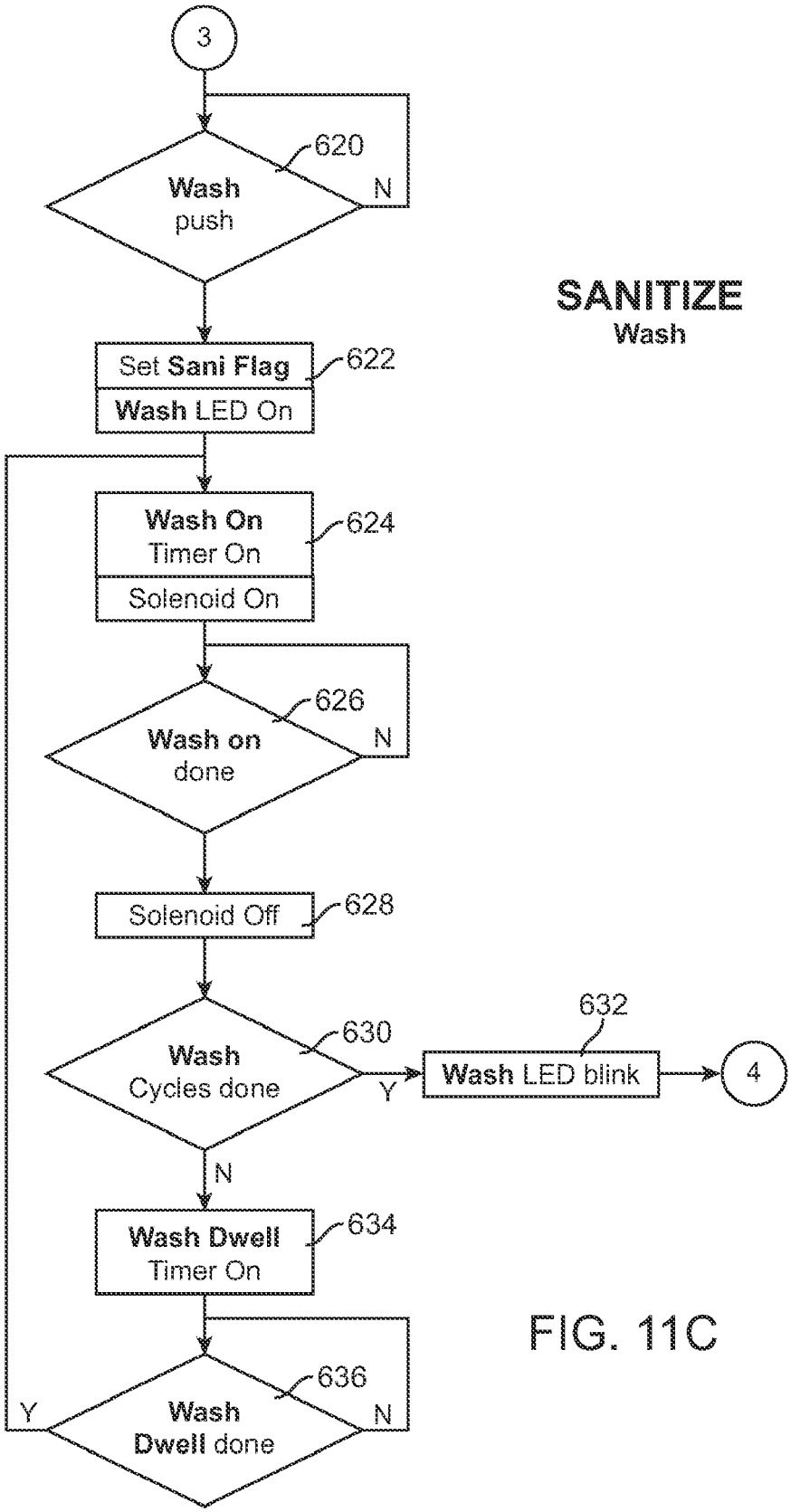

FIG. 11C illustrates the logic for the wash cycle portion of the sanitization mode. As shown in FIG. 11C, the sanitize mode can be entered by selecting the sanitize toggle or switch (step 604). State 3 is the start of the sanitization mode. The sanitization mode can start with a wash cycle. The wash cycle can include one or more wash cycles and each wash cycles can include a duration during which the pump is on and dispenser is being actively washed and a period during which the pump is off and the cleaning fluid is held in the system for a dwell or a soaking duration. The combination of pumped washing and dwelled or soaked washing ensures a thorough and effective cleaning for the dispenser in general and its food contacted dispensing path in particular. At step 620, it is determined whether the wash switch has been activated. If a wash switch has not been activated, control returns to state 3. If a wash switch has been activated, the Sani Flag is set and the wash LED comes on (step 622). Once the Sani Flag is set, the controller will ignore input from any input switches, such as input switches for causing a product dispense or any other switches. Next at step 624, a wash on timer is turned on and the solenoid controlling the faucet is turned on. The dispenser is now ready to enter the wash mode. At step 626 it is determined whether the washing is complete. If it is determined that washing is done, the solenoid is turned off (step 628). If however, the washing is not complete, then washing continues. Next at step 630 it is determined whether the wash cycles have been completed. If wash cycles are not complete, a wash dwell timer is turned on (step 634). This specifies the soak, or dwell duration, where the dispense system is filled with the washing fluid and held in this soak state to effectively soak and clean the dispenser. Once the wash dwell timer has been turned on (step 634), the dwell state persists until its timed dwell time has been completed. At step 636, it is determined whether the wash dwell is done. If so, the dwell or soak portion of the wash is completed and control return to step 624. In this manner, the wash cycle of the sanitization mode can include more than one cycle that itself can include wash and soak portions. If at step 630, it is determined that the entire wash cycles are done, then the wash LED is set to a blinking state, and control moves to state 4, or the rinse cycle.

Figure 11D:
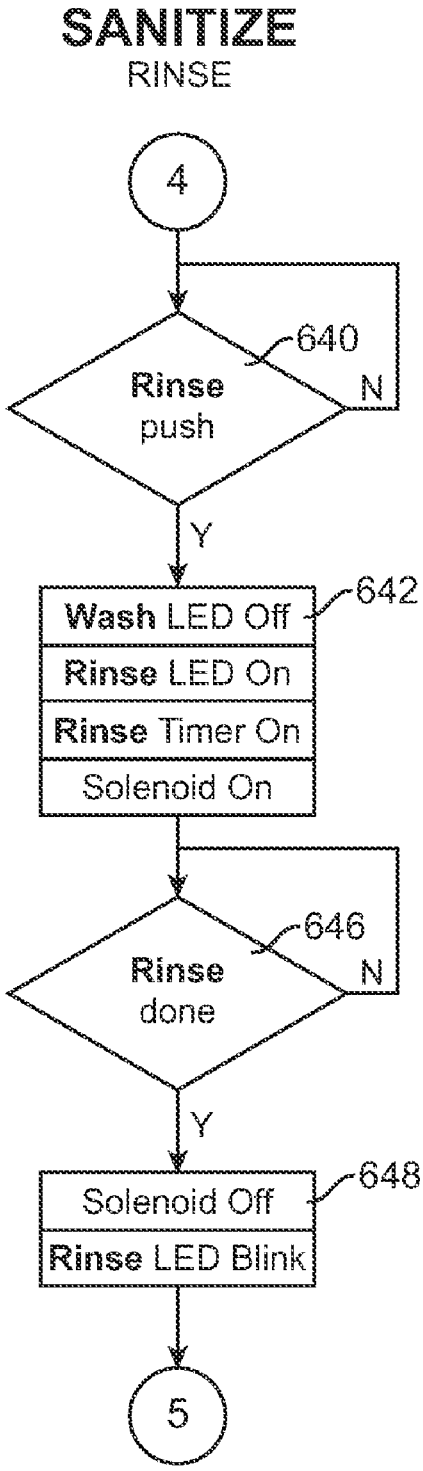

FIG. 11D illustrates the logic for the rinse cycle portion of the sanitization mode. As shown in FIG. 11D, State 4 is the start of the rinse cycle portion of the sanitization mode. The rinse cycle is entered by activating the rinse switch. At step 640, when it is determined that the rinse switch has been activated, control moves to step 642, where wash LED is turned off, the rinse LED is turned on and the solenoid for the faucet is turned on to enable the rinsing fluid to be circulated through the system. At step 646, it is determined whether the rinse cycle is done, for example by checking the rinse timer. If the rinse cycle is not completed, it is continued until the cycle is completed. Once the rinse cycles is completed, control moves to step 648 where the solenoid is turned off, and the rinse LED is set to a blinking state so as to indicate that the rinse cycle is complete. After the completion of the rinse cycle, control moves to state 5, or the sanitize cycle of the sanitization mode.

Figure 11E:
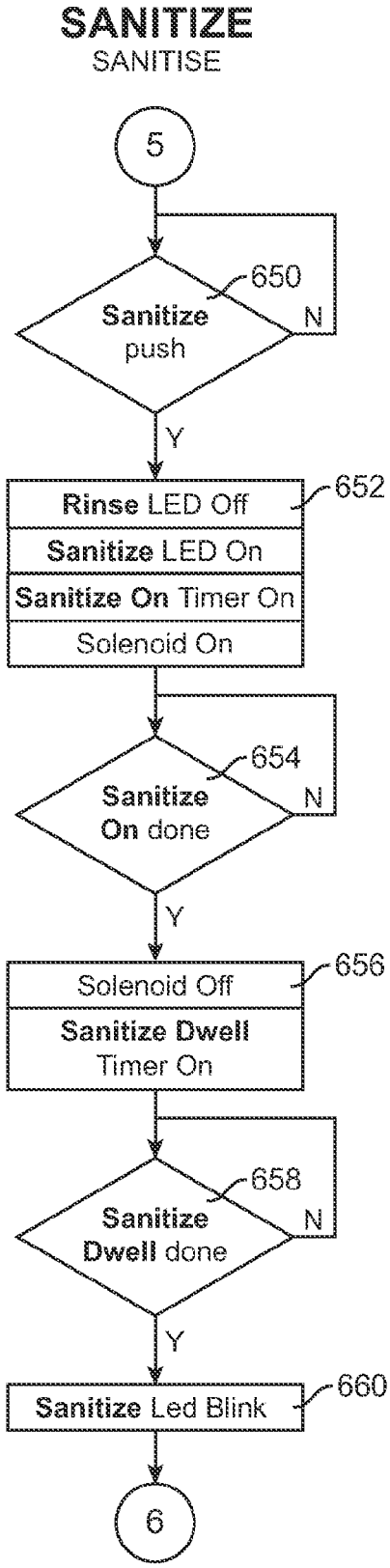

FIG. 11E illustrates the logic for the sanitize cycle portion of the sanitization mode. As shown in FIG. 11E, State 5 is the start of the sanitize cycle portion of the sanitization mode. The sanitize cycle, in a manner similar to the wash cycle includes both active pumped sanitizing and soak or dwell sanitizing with solenoid valve in an off position. In other words, the sanitize cycle can include a duration during which the pump is on and dispenser is being actively sanitized and a period during which the pump is off and the cleaning fluid is held in the system for a dwell or a soaking duration. The combination of pumped sanitizing and dwelled or soaked sanitizing ensures a thorough and effective cleaning and sanitizing for the dispenser in general and its food contacted dispensing path in particular. The sanitize cycle is entered by activating the sanitize witch. At step 650, when it is determined that the sanitize switch has been activated, control moves to step 652, where the rinse LED is turned off, the sanitize LED is turned on, the sanitize on timer is turned on and the solenoid for the faucet is turned on to enable the sanitizing fluid to be circulated through the system. At step 654, it is determined whether the sanitize cycle is done, for example by checking the sanitize timer. If the sanitize cycle is not completed, it is continued until the cycle is completed. Once the sanitize cycle is completed, control moves to step 656 where the solenoid is turned off, and the sanitize dwell timer is turned on. At step 658, it is determined whether the sanitize dwell cycle is done, for example by checking the sanitize dwell timer. If the sanitize dwell cycle is not completed, it is continued until the cycle is completed. Once the sanitize dwell period has been completed, control moves to step 660, where the sanitize cycle is completed and its completion is indicted by the sanitize LED being placed in a blinking state. Control then moves to State 6, or the prime portion of the sanitize cycle.

Figure 11F:
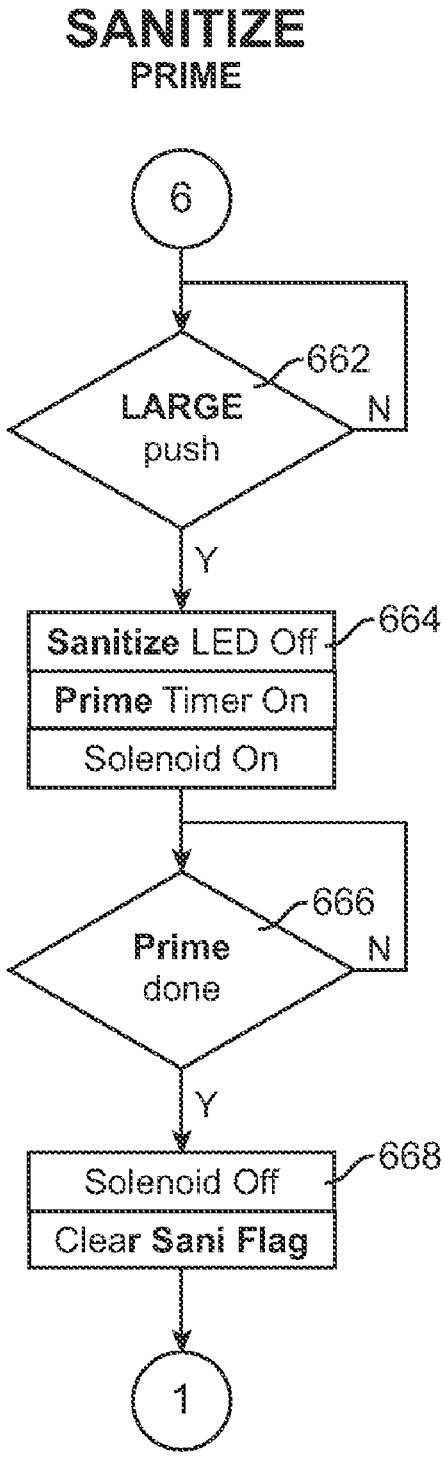

FIG. 11F illustrates the logic for the prime cycle portion of the sanitization mode. The prime cycle is used when the washing/rinsing/sanitizing solutions are disconnected from the pump and the refrigerated liquid product is reconnected with the pump. The priming cycle is carried out before the dispenser is returned to it normal dispense mode. The priming cycle is entered by activating the large dispense switch or other switch. At step 662, when it is determined that the appropriate priming switch has been activated, control moves to step 664, where the sanitize LED is turned off, the prime timer is turned on and the solenoid is turned on. At step 666, it is determined whether the prime cycle is done, for example by checking the prime timer. If the prime cycle is not completed, it is continued until the cycle is completed. Once the prime cycles is completed, control moves to step 668 where the solenoid is turned off, and the Sani Flag is cleared. The control then moves to State 1. Now that the Sani Flag is cleared, the activation of the main control switch 202 can place the dispenser in its normal dispense mode.

Figure 12A:
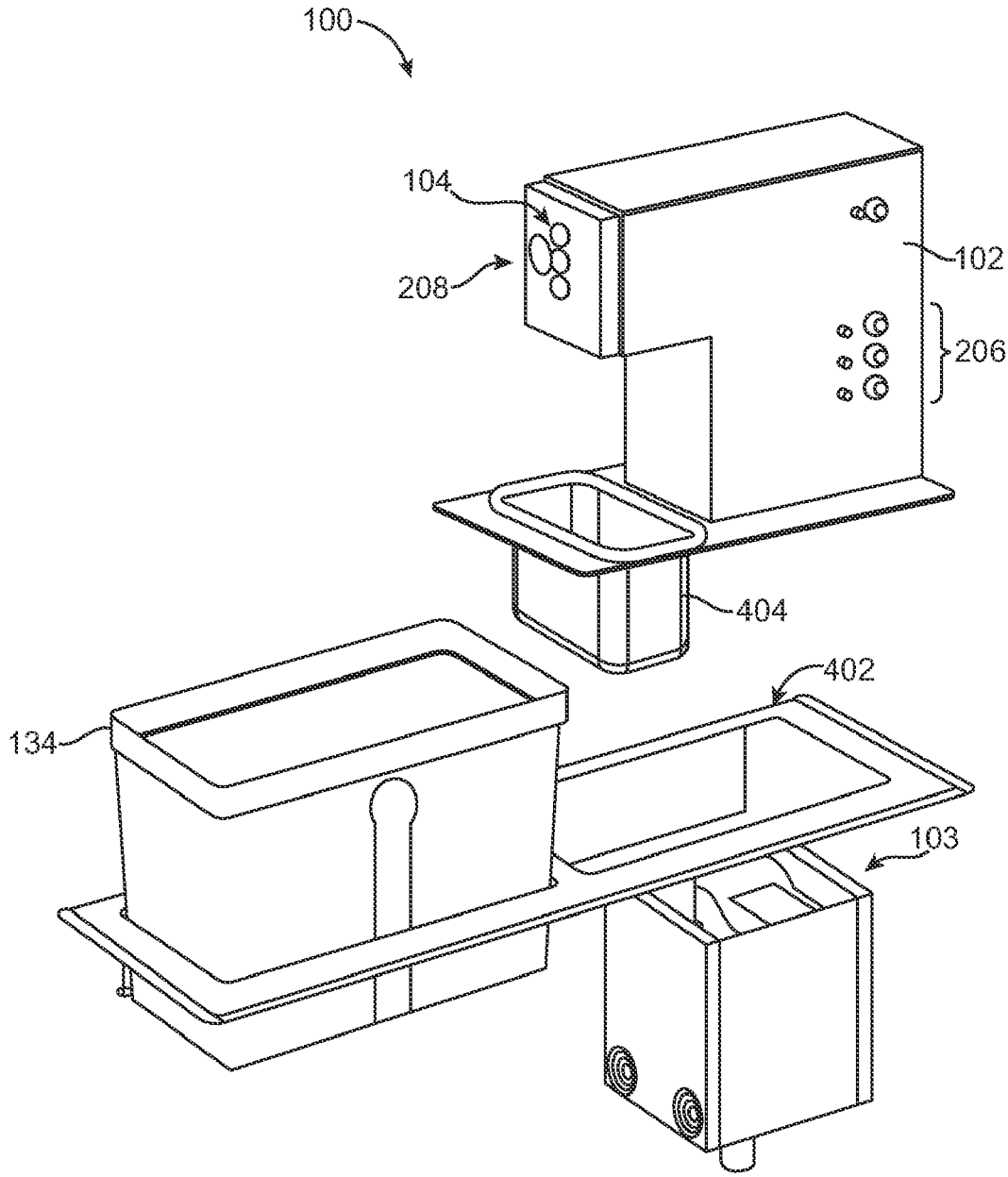
FIG. 12A is a simplified exemplary drawing of an alternative embodiment of the refrigerated liquid dispenser of the present invention.

FIG. 12A is a simplified exemplary drawing of an alternative embodiment of the refrigerated liquid dispenser 100 of the present invention. FIG. 12A shows an exemplary configuration for components of the refrigerated liquid dispenser. As can be seen, the dispenser can include the tower portion 102, the pump enclosure 103, a liquid product bag holder 134 and a rack 402. The rack 402 can be used to convert a manual standard cold table work station to an automatic refrigerated liquid dispenser. The rack 402 is used to support the dispenser system components. The rack 402 can include two openings for typical ⅓ pans to accommodate the dispenser and the cold table environment. A drip pan 404 is also shown, and can be used to collect small drips from the dispenser and to help maintain sanitary conditions. The tower 102 can house the faucet and the controls, as well as the auxiliary cooling circuit. The tower 102 can have two different sets of switches. One set 104 can be used to control the dispenser, to deliver different sized portions (e.g., small, medium, and large). Another set 206 are used to control the wash/rinse/sanitize cycles of the sanitization mode. The pump enclosure 103 holds the pump and part of the ductwork for the auxiliary cooling circuit. The embodiment shown in FIG. 12A can be used for an inline, under counter refrigerator application.

Figure 12B:
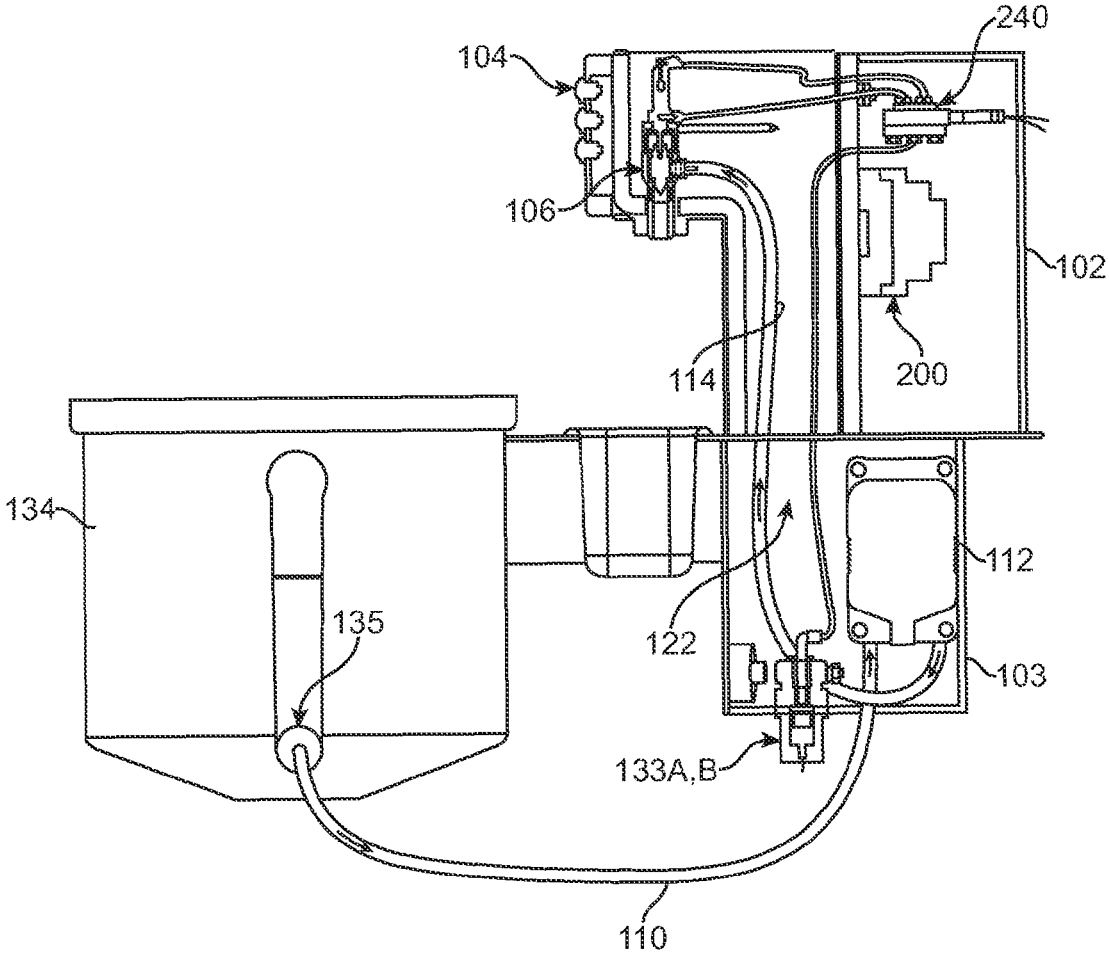
FIG. 12B is a sectional view corresponding to the refrigerated liquid dispenser of FIG. 12A.

FIG. 12B is a sectional view corresponding to the refrigerated liquid dispenser of FIG. 12A. FIG. 12B shows the embodiment of FIG. 12A when used for an inline, under counter refrigerator application. As is shown in FIG. 12B, connectors 135 connect the pump inlet conduit 110 to the pump 112. The pump 112 is shown as a pneumatic diaphragm-type pump. The liquid product gets pumped by pump 112 for delivery via faucet 106. The faucet 106 shown can be an air-operated valve. Activation of the switched 104 will caused the air operated valve to open under the control of the PLC 200 and the air operation control valve 240. Auxiliary cooling is provided by the routing of cooling air duct 122 into the tower portion to keep that space cold in the range of about 35-40° F.

Figure 13A:
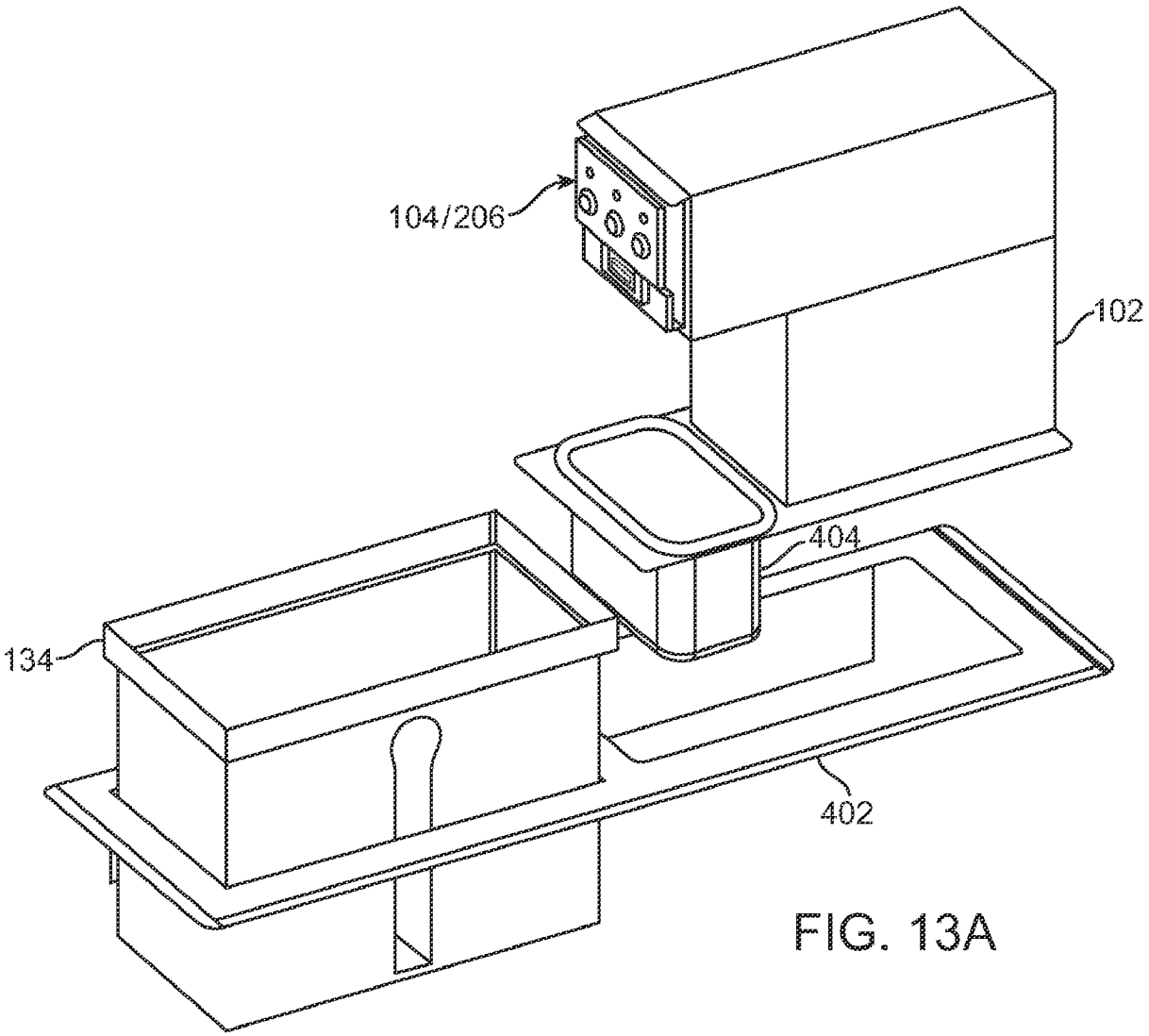
FIG. 13A is a simplified exemplary drawing of another alternative embodiment of the refrigerated liquid dispenser of the present invention.

FIG. 13A is a simplified exemplary drawing of another alternative embodiment of the refrigerated liquid dispenser of the present invention. While the embodiment shown in FIGS. 12A-B uses a pneumatic pump, the embodiment shown in FIG. 13A uses an electric pump. In addition, the embodiment shown in FIG. 13A uses a motor and a gear box to meter the dispensing and thus avoid the use of solenoid valve and the associated timer-based operations, as described above. As can be seen, the dispenser includes the tower portion 102, a liquid product bag holder 134 and a rack 402. The rack 402 can be used to convert a manual standard cold table work station to an automatic refrigerated liquid dispenser. The rack is used to support the dispenser system components. The rack 402 can include two openings for typical ⅓ pans to accommodate the dispenser and the cold table environment. A drip pan 404 is also shown, and can be used to collect small drips from the dispenser and to help maintain sanitary conditions. The tower 102 can house the faucet and the controls, as well as the auxiliary cooling circuit. The tower 102 is shown to have one set of switches 104/206. The same set of switches can be used to control the dispenser, to deliver different sized portions (e.g., small, medium, and large), and to control the wash/rinse/sanitize cycles of the sanitization mode. The tower 102 holds the pump and part of the ductwork for the auxiliary cooling circuit. The embodiment shown in FIG. 13A can be used for an inline, under counter refrigerator application.

Figure 13B:
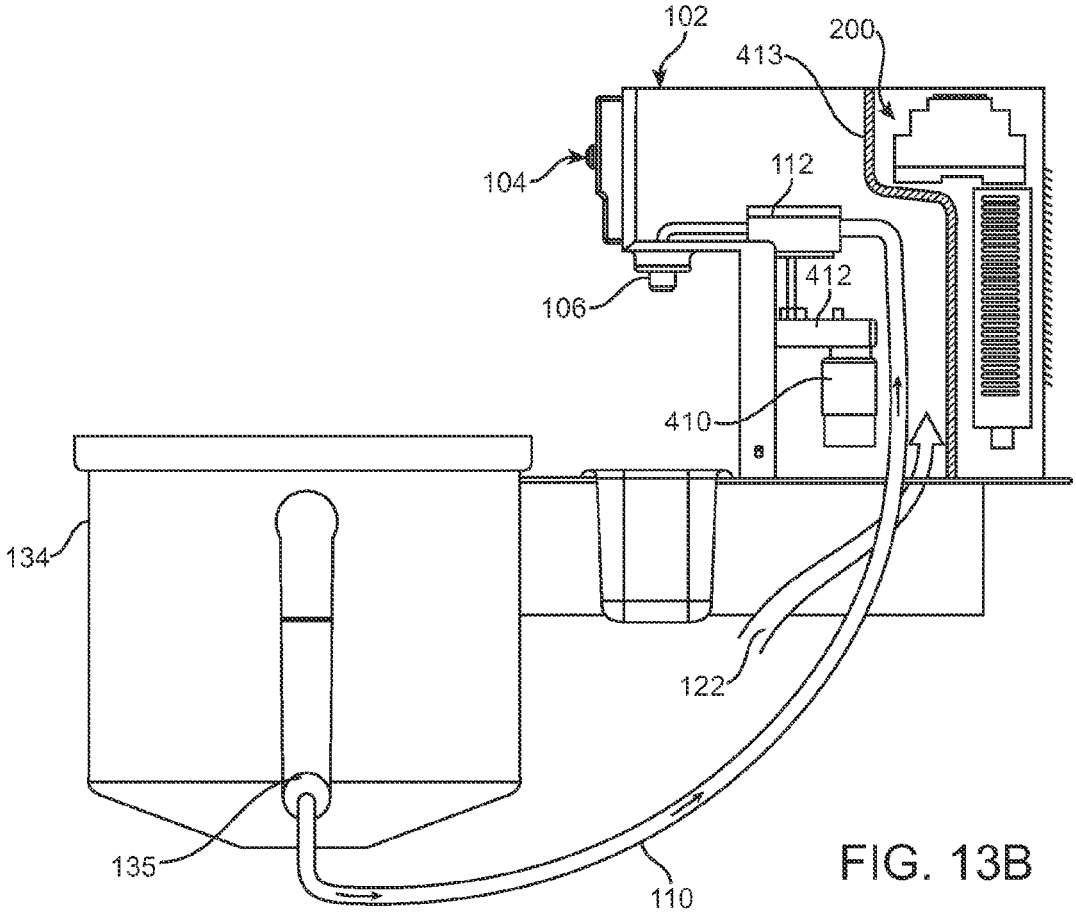
FIG. 13B is a sectional view corresponding to the refrigerated liquid dispenser of FIG. 13A.

FIG. 13B is a sectional view corresponding to the refrigerated liquid dispenser of FIG. 13A. FIG. 13B shows the embodiment of FIG. 13A when used for an inline, under counter refrigerator application. As is shown in FIG. 13B, connector 135 can connect the pump inlet conduit 110 to the pump 112. The pump is shown as an centrifugal or rotary pump. The liquid product gets pumped by pump 112 for delivery via faucet 106'. Activation of the switched 104 will caused the pump in combination with the motor 410 and gear box 412 to meter the right amount of product under the control of the PLC 200. Auxiliary cooling is provided by the routing of cooling air duct 122 into the tower portion to keep that space cold in the range of about 35-40° F. Also shown in the tower is an insulating wall 413 that separates the heat generating portions of the tower (e.g. power supply) from the areas cooled by the auxiliary cooling circuit. In this manner the closed loop cooling circuit does not have to also remove the heat from the heat generating portions of the tower (e.g. power supply), thus resulting in an efficient cooling of the tower portion. In addition to insulator 413, the auxiliary cooling circuit and the cooling duct 122 itself may also be insulated.

In addition to the above exemplary dispensers, it should be noted that another embodiment can use a rather disposable, food contact dispensing path. In this embodiment, a peristaltic pumping system can be used. Such a system provides the additional advantage of also having a pump that can be easily and effectively cleaned and sanitized. A peristaltic pump is a type of positive displacement pump used for pumping a variety of fluids. The fluid is contained within a flexible tube fitted inside a circular pump casing. A rotor with a number of rollers, shoes or wipers attached to the external circumference compresses the flexible tube. As the rotor turns, the part of tube under compression closes (or occludes) thus forcing the fluid to be pumped to move through the tube. Peristaltic pumps are typically used to pump clean or sterile fluids because the pump cannot contaminate the fluid, or to pump aggressive fluids because the fluid cannot contaminate the pump. Some common applications include use in food manufacturing, beverage dispensing, pumping aggressive chemicals, high solids slurries and other materials where isolation of the product from the environment, and the environment from the product, are critical.

The above description is illustrative and is not restrictive, and as it will become apparent to those skilled in the art upon review of the disclosure, the present invention may be embodied in other specific forms without departing from the essential characteristics thereof. These other embodiments are intended to be included within the scope of the present invention. The subject matter of the present invention may however be embodied in many different forms and should not be construed as being limited to the embodiments set forth herein. For example, the refrigerated liquid dispenser can use any type of pump. Or that the operational logic may be achieved by implemented some or all of the steps described above. The steps may be combined or broken down, and they may be carried out in the order disclosed or any other suitable order. The scope of the invention should, therefore, be determined not with reference to the above description, but instead should be determined with reference to the following and pending claims along with their full scope or equivalents.

What is claimed is:

1. A refrigerated liquid dispenser, comprising:

a pump configured for being in fluid communication with a source of a liquid product;

a dispensing faucet configured for being in fluid communication with said pump, said dispensing faucet including a cold maintenance device located near the distal end of the dispensing faucet and an insulator device disposed adjacent to said cold maintenance device, said cold maintenance device having a distal end that projects beyond a lower surface of said insulator device;

a dispensing tower for enclosing the dispensing faucet;

an auxiliary cooling circuit configured to direct cool airflow toward said dispensing faucet, said auxiliary cooling circuit having a passageway that is at least partially located within said dispensing tower and said passageway is configured to deliver cool airflow through said passageway onto said dispensing faucet, to shield said dispensing faucet from ambient temperature, thereby maintaining said dispensing faucet and said passageway at a cool temperature to avoid contamination of the liquid; and a controller operatively coupled with said pump and said dispensing faucet to control the operation of said refrigerated liquid dispenser.

2. The refrigerated liquid dispenser of claim 1, wherein said pump includes a discharge conduit that runs partly though said passageway.

3. The refrigerated liquid dispenser of claim 1, wherein said cold maintenance device is made of a material that has a higher heat capacity than that of the insulator device.

4. The refrigerated liquid dispenser of claim 1, wherein said cold maintenance device is made of a material that has a higher thermal conductivity than that of the insulator device.

5. The refrigerated liquid dispenser of claim 1, wherein said auxiliary cooling circuit further comprises a fan in fluid communication with said passageway.

6. The refrigerated liquid dispenser of claim 1, wherein said auxiliary cooling circuit further comprises an intake structure at the inlet to said passageway to encourage the routing of cool air flow into said passageway.

7. The refrigerated liquid dispenser of claim 1, further comprising a sanitizing connector adapter configured to connect with the distal end of said dispensing faucet.

8. The refrigerated liquid dispenser of claim 7, wherein said sanitizing connector adapter is configured to fit over said insulator device, said sanitizing connector adapter when fitted to said insulator device creating a space that surrounds said distal end of said cold maintenance device.

9. The refrigerated liquid dispenser of claim 8, wherein said sanitizing connector adapter is configured to form a seal and fit over said insulator device, such that when said space is filled with a cleaning fluid, said distal end of said cold maintenance device is surrounded by said cleaning fluid.

10. The refrigerated liquid dispenser of claim 1, further comprising a bag holder configured to hold a bag of liquid product.

11. The refrigerated liquid dispenser of claim 10, further comprising an adapter configured to connect the bag with the inlet side of said pump.

12. The refrigerated liquid dispenser of claim 1, further comprising a control selector switch operatively connected with said controller, said control selector switch being selectable to operate the refrigerated liquid dispenser in a normal dispense mode and a cleaning mode.

13. The refrigerated liquid dispenser of claim 12, further comprising a dispense selector switch operatively connected with said controller, wherein said dispense selector switch is configured to cause said dispenser to dispense a predetermined amount of liquid product through said dispensing faucet.

14. The refrigerated liquid dispenser of claim 12, further comprising a cleaning mode selector switch operatively connected with said controller, wherein said cleaning mode selector switch is configured to operate the refrigerated liquid dispenser in a wash mode, a rinse mode and a sanitize mode.

15. The refrigerated liquid dispenser of claim 14, wherein in said wash mode, said controller is configured to cause a washing solution to be delivered from a source of a washing fluid through the dispensing faucet, so as to implement a wash cycle.

16. The refrigerated liquid dispenser of claim 15, wherein said wash cycle includes a first period during which said pump is operating and said dispensing faucet is open and a second period during which said dispensing faucet is closed.

17. The refrigerated liquid dispenser of claim 16, wherein said wash cycle is one of several wash cycles.

18. The refrigerated liquid dispenser of claim 14, wherein in said rinse mode, said controller is configured to cause a rising solution to be delivered from a source of a rinsing fluid through the dispensing faucet, so as to implement a rinse cycle.

19. The refrigerated liquid dispenser of claim 14, wherein in said sanitize mode, said controller is configured to cause a sanitizing solution to be delivered from a source of a sanitizing fluid through the dispensing faucet, so as to implement a sanitizing cycle.

20. The refrigerated liquid dispenser of claim 19, wherein said sanitize cycle includes a first period during which said pump is operating and said dispensing faucet is open and a second period during which said dispensing faucet is closed.

21. The refrigerated liquid dispenser of claim 1, further comprising a temperature sensor configured for sensing the temperature within the dispensing tower near the dispensing faucet.

22. The refrigerated liquid dispenser of claim 21, further comprising a display operatively coupled with said temperature sensor.

23. The refrigerated liquid dispenser of claim 21, wherein said temperature sensor is operatively coupled with said controller, said controller being configured to prevent the dispensing of the liquid product when an over temperature condition is sensed by said temperature sensor.

24. The refrigerated liquid dispenser of claim 1, wherein said dispensing faucet is solenoid operated.

25. The refrigerated liquid dispenser of claim 24, wherein said pump is configured to deliver a substantially fixed flow rate, and wherein the total liquid product portion being dispensed by the refrigerated liquid dispenser is determined in part by a time period during which the dispensing faucet is kept open.

26. The refrigerated liquid dispenser of claim 1, wherein said pump is a diaphragm, a centrifugal, or a peristaltic pump.

27. A refrigerated liquid dispenser, comprising:

a pump configured for being in fluid communication with a source of a liquid product;

a dispensing faucet configured for being in fluid communication with said pump, said dispensing faucet including a cold maintenance device located near the distal end of the dispensing faucet and an insulator device disposed adjacent to said cold maintenance device, said cold maintenance device having a distal end that projects beyond a lower surface of said insulator device;

a dispensing tower for enclosing the dispensing faucet;

an auxiliary cooling circuit configured to direct cool airflow toward said dispensing faucet, said auxiliary cooling circuit having a passageway that is at least partially located within said dispensing tower and said passageway is configured to deliver cool airflow through said passageway onto said dispensing faucet, to shield said dispensing faucet from ambient temperature, thereby maintaining said dispensing faucet and said passageway at a cool temperature to avoid contamination of the liquid;

a controller operatively coupled with said pump and said dispensing faucet to control the operation of said refrigerated liquid dispenser, and a sanitizing connector adapter configured to connect with the distal end of said dispensing faucet, wherein said sanitizing connector adapter is configured to fit over said insulator device, said sanitizing connector adapter when fitted to said insulator device creating a space that surrounds said distal end of said cold maintenance device, and wherein said sanitizing connector adapter is configured to form a seal and fit over said insulator device, such that when said space is filled with a cleaning fluid, said distal end of said cold maintenance device is surrounded by said cleaning fluid.

28. A refrigerated liquid dispenser, comprising:

a pump configured for being in fluid communication with a source of a liquid product;

a dispensing faucet configured for being in fluid communication with said pump, said dispensing faucet including a cold maintenance device located near the distal end of the dispensing faucet and an insulator device disposed adjacent to said cold maintenance device, said cold maintenance device having a distal end that projects beyond a lower surface of said insulator device;

a dispensing tower for enclosing the dispensing faucet;

an auxiliary cooling circuit configured to direct cool airflow toward said dispensing faucet, said auxiliary cooling circuit having a passageway that is at least partially located within said dispensing tower and said passageway is configured to deliver cool airflow through said passageway onto said dispensing faucet, to shield said dispensing faucet from ambient temperature, thereby maintaining said dispensing faucet and said passageway at a cool temperature to avoid contamination of the liquid;

a controller operatively coupled with said pump and said dispensing faucet to control the operation of said refrigerated liquid dispenser;

a control selector switch operatively connected with said controller, said control selector switch being selectable to operate the refrigerated liquid dispenser in a normal dispense mode and a cleaning mode;

a dispense selector switch operatively connected with said controller, wherein said dispense selector switch is configured to cause said dispenser to dispense a predetermined amount of liquid product through said dispensing faucet; and a cleaning mode selector switch operatively connected with said controller, wherein said cleaning mode selector switch is configured to operate the refrigerated liquid dispenser in a wash mode, a rinse mode and a sanitize mode.

* * * * *